US009016176B2

(12) United States Patent
Nobukuni

(10) Patent No.: US 9,016,176 B2
(45) Date of Patent: Apr. 28, 2015

(54) WEB MEMBER CUTTING APPARATUS FOR CUTTING WEB MEMBER THAT HAS A PLURALITY OF FIBERS INCLUDING TOWS AND WEB MEMBER CUTTING METHOD

(71) Applicant: Unicharm Corporation, Ehime (JP)

(72) Inventor: Hisaoki Nobukuni, Kanonji (JP)

(73) Assignee: Unicharm Corporation, Ehime (JP)

( * ) Notice: Subject to any disclaimer, the term of this patent is extended or adjusted under 35 U.S.C. 154(b) by 273 days.

(21) Appl. No.: 13/755,138

(22) Filed: Jan. 31, 2013

(65) Prior Publication Data

US 2013/0305891 A1 Nov. 21, 2013

(30) Foreign Application Priority Data

May 21, 2012 (JP) ..... 2012-115783

(51) Int. Cl.

| | |
|---|---|
| ***B26D 5/20*** | (2006.01) |
| ***B26D 7/32*** | (2006.01) |
| ***B26D 7/01*** | (2006.01) |
| ***B26D 7/06*** | (2006.01) |
| *B26D 1/18* | (2006.01) |
| *B26D 7/14* | (2006.01) |

(52) U.S. Cl.

CPC *B26D 7/32* (2013.01); *B26D 7/015* (2013.01); *B26D 1/18* (2013.01); *B26D 7/0625* (2013.01); *B26D 7/14* (2013.01)

(58) Field of Classification Search

CPC ..... B26D 1/185; B26D 1/18; B26D 1/157; B26D 1/1575; B26D 7/32; B26D 7/0625; B26D 4/015; B26D 7/14

USPC ..... 83/409, 409.1, 485, 266, 471.2, 488, 83/734, 422, 408, 331, 341, 42, 262, 499, 83/225–230, 202, 205; 26/7; 28/170, 147

See application file for complete search history.

(56) References Cited

U.S. PATENT DOCUMENTS 760,800 A * 5/1904 Nice ..... 83/455
855,301 A * 5/1907 Gobie ..... 83/471.2

(Continued)

FOREIGN PATENT DOCUMENTS

JP 578496 U 10/1993
JP 6315888 A 11/1994

(Continued)

OTHER PUBLICATIONS

International Search Report mailed on Jul. 16, 2013 corresponds to PCT/JP2013/063011.

*Primary Examiner* — Sean Michalski

(74) *Attorney, Agent, or Firm* — Lowe Hauptman & Ham, LLP

(57) ABSTRACT

A web-member cutting apparatus for cutting a web member at intervals in a transport direction includes: an intermittent transport mechanism for intermittently transporting the web member in the transport direction; a disc-like rotatable blade member for cutting the web member by moving along an intersecting direction while rotating about a rotation shaft during a suspension period of transport of the web member, and a downstream pressing member for regulating movement of the web member by pressing the web member against the intermittent transport mechanism at a position downstream from a target cut position in the transport direction throughout a period during which the rotatable blade member is cutting the web member.

11 Claims, 11 Drawing Sheets

(56) References Cited

U.S. PATENT DOCUMENTS

| | | | | | |
|---|---|---|---|---|---|
| 1,079,998 | A * | 12/1913 | Arrants | 83/487 |
| 1,434,475 | A * | 11/1922 | Austin | 83/455 |
| 1,615,901 | A * | 2/1927 | Carlson | 83/485 |
| 1,735,520 | A * | 11/1929 | Williams | 83/485 |
| 1,949,490 | A * | 3/1934 | Ross | 30/264 |
| 2,759,542 | A * | 8/1956 | Weisshuhn | 83/429 |
| 3,143,023 | A * | 8/1964 | Addin | 83/472 |
| 3,605,537 | A * | 9/1971 | Pickler | 83/121 |
| 3,657,952 | A * | 4/1972 | Brockbank et al. | 83/102 |
| 3,665,982 | A * | 5/1972 | Kvalheim | 83/404.2 |
| 3,821,915 | A * | 7/1974 | Larrable | 83/174 |
| 3,910,142 | A * | 10/1975 | Jureit et al. | 83/74 |
| 4,353,274 | A * | 10/1982 | Shimizu | 83/156 |
| 4,444,077 | A * | 4/1984 | Wise et al. | 83/319 |
| 4,452,117 | A * | 6/1984 | Brickner et al. | 83/468 |
| 4,548,108 | A * | 10/1985 | Dennis | 83/27 |
| 4,649,782 | A * | 3/1987 | Cavagna | 83/425.4 |
| 4,813,316 | A * | 3/1989 | Johnson et al. | 83/42 |
| 5,033,344 | A * | 7/1991 | Ohneda et al. | 83/262 |
| 5,046,392 | A * | 9/1991 | Keon et al. | 83/862 |
| 5,249,491 | A * | 10/1993 | Carter | 83/13 |
| 5,355,156 | A * | 10/1994 | Balzeit et al. | 346/138 |
| 5,715,738 | A * | 2/1998 | Yetman | 83/614 |
| 6,014,921 | A * | 1/2000 | Angel et al. | 83/862 |
| 6,056,682 | A * | 5/2000 | Belanger et al. | 493/340 |
| 6,119,675 | A * | 9/2000 | Akram et al. | 125/23.01 |
| 6,212,983 | B1 * | 4/2001 | Pyle | 83/34 |
| 6,308,602 | B1 * | 10/2001 | Gerber | 83/76.6 |
| 6,394,330 | B1 * | 5/2002 | Jackson | 225/2 |
| 6,418,825 | B1 * | 7/2002 | Hartmann | 83/110 |
| 6,640,855 | B2 * | 11/2003 | Giles | 144/357 |
| 6,644,154 | B2 * | 11/2003 | Wierschke et al. | 83/174 |
| 6,681,669 | B1 * | 1/2004 | Bogan | 83/176 |
| 6,732,625 | B1 * | 5/2004 | Boynton et al. | 83/482 |
| 6,782,889 | B2 * | 8/2004 | Ducci et al. | 131/84.1 |
| 6,813,985 | B2 * | 11/2004 | Gharst et al. | 83/863 |
| 7,000,658 | B1 * | 2/2006 | Soukiassian et al. | 144/3.1 |
| 7,047,856 | B2 * | 5/2006 | Nurenberg et al. | 83/471.3 |
| 7,124,672 | B2 * | 10/2006 | Marocco | 83/197 |
| 7,284,305 | B1 * | 10/2007 | Allen et al. | 26/7 |
| 7,430,948 | B2 * | 10/2008 | De Marco et al. | 83/236 |
| 7,434,373 | B2 * | 10/2008 | Pommier | 53/435 |
| 7,861,630 | B2 * | 1/2011 | Sorensen et al. | 83/42 |
| 2001/0022285 | A1 * | 9/2001 | Gambini | 209/698 |
| 2003/0079589 | A1 * | 5/2003 | Kovacs | 83/42 |
| 2004/0069106 | A1 * | 4/2004 | McAdoo | 83/34 |
| 2004/0221700 | A1 * | 11/2004 | Williams et al. | 83/236 |
| 2005/0097695 | A1 | 5/2005 | Tanaka et al. | |
| 2005/0211031 | A1 * | 9/2005 | James et al. | 83/13 |
| 2006/0179989 | A1 * | 8/2006 | James et al. | 83/284 |
| 2008/0034936 | A1 * | 2/2008 | Loibl | 83/455 |
| 2008/0110311 | A1 * | 5/2008 | Stangherlin | 83/177 |
| 2009/0211420 | A1 * | 8/2009 | Loibl | 83/485 |
| 2009/0266211 | A1 * | 10/2009 | Westfall et al. | 83/208 |
| 2010/0024621 | A1 * | 2/2010 | Van Cleave et al. | 83/471.2 |
| 2010/0257984 | A1 * | 10/2010 | Scaroni et al. | 83/13 |
| 2011/0308097 | A1 * | 12/2011 | Vollrath | 30/388 |
| 2012/0167736 | A1 | 7/2012 | Yokoe | |
| 2013/0087029 | A1 * | 4/2013 | Iyatani | 83/13 |
| 2013/0305894 | A1 * | 11/2013 | Nobukuni | 83/37 |

FOREIGN PATENT DOCUMENTS

| | | |
|---|---|---|
| JP | 2005-040641 | 2/2005 |
| JP | 2006159382 A | 6/2006 |
| JP | 2011-062802 | 3/2011 |

* cited by examiner

WEB MEMBER CUTTING APPARATUS FOR CUTTING WEB MEMBER THAT HAS A PLURALITY OF FIBERS INCLUDING TOWS AND WEB MEMBER CUTTING METHOD

CROSS-REFERENCE TO RELATED APPLICATIONS

The present application claims priority from Japanese Patent Application No. 2012-115783 filed on May 21, 2012, which are herein incorporated by reference.

BACKGROUND

1. Technical Field

The present invention relates to an apparatus and a method for cutting a web member that has a plurality of fibers including tows.

2. Related Art

A conventional cleaning web member is known into which a handle member is inserted to make the web member usable for cleaning of a tabletop and the like (JP 2005-40641A). Such a cleaning web member has a main body in which a plurality of fibers are layered on a base sheet. As the fibers, used are thermoplastic fibers, called tows.

In the production line of the cleaning web member, a plurality of tows whose fiber direction is in a transport direction are secured by means such as welding to a base sheet that is continuous along the transport direction. Thus, a web member that is continuous in the transport direction is formed as a semi-finished product. Finally, this web member is cut at a product pitch along the transport direction so that single-cut cleaning web members are manufactured.

As a method for cutting this web member, the cutting apparatus disclosed in JP 2011-62802A can be considered. That is to say, the web member is cut by passing the web member through a space between a cutter roll and an anvil roll and pressing the web member between the cutter blade and the receiver blade. The cutter roll has a outer circumferential face having a cutter blade, and the anvil roll has a receiver blade that receives the cutter blade.

However, the tows used in the web member are thermoplastic fiber. Therefore, tows are attached at the target cut position by welding or compression-bonding because the web member is pressed between the cutter blade and the receiver blade during cutting. This may cause a trouble that the cut edges is bound to each other in loops, which results in deterioration of the performance of the brush section (dust trapping performance during cleaning).

Furthermore, if the cut edges are bound to each other in loops, bulkiness of the cleaning web member decreases, which also lowers the performance of the brush section.

Furthermore, due to contact of the cutter blade with the receiver blade during cutting, the cutting edge of the cutter blade is likely to be worn, which shortens the life of the cutter blade.

SUMMARY

The invention has been made in view of the above conventional problems, and an advantage thereof is to provide a cutting apparatus and a cutting method for cutting a web member at intervals in the transport direction, the web member having a plurality of fibers including tows along a transport direction, the web member being continuous in the transport direction. The apparatus and the method achieve a good cutting performance while suppressing compression-bonding and welding of tows at a target cut position. The apparatus and the method also make it possible to maintain high bulkiness of a cut sheet-like product of the web member formed by cutting, and make it possible to suppress wear of a cutting edge.

An aspect of the invention to achieve the above advantage is a web-member cutting apparatus for cutting a web member at intervals in a transport direction, the web member having a plurality of fibers including tows along the transport direction and being continuous in the transport direction, the web-member cutting apparatus including:

an intermittent transport mechanism that intermittently transports the web member in the transport direction;

a disc-like rotatable blade member that cuts the web member by moving along an intersecting direction while rotating about a rotation shaft during a suspension period of transport of the web member, the intersecting direction intersecting the transport direction, the rotation shaft extending along the transport direction; and a downstream pressing member that regulates movement of the web member by pressing the web member against the intermittent transport mechanism at a position downstream from a target cut position in the transport direction throughout a period during which the rotatable blade member is cutting the web member.

Further, a method for cutting a web member at intervals in a transport direction, the web member having a plurality of fibers including tows along the transport direction and being continuous in the transport direction, the method comprising:

intermittently transporting the web member in the transport direction;

cutting the web member by moving a disc-like rotatable blade member along an intersecting direction with the rotatable blade member rotating about a rotation shaft during a suspension period of transport of the web member, the intersecting direction intersecting the transport direction, the rotation shaft extending along the transport direction; and regulating movement of the web member by pressing the web member against the intermittent transport mechanism at a position downstream from a target cut position in the transport direction throughout a period during which the rotatable blade member is cutting the web member.

Other features of this invention will become apparent from the description in this specification and the attached drawings.

DESCRIPTION OF EXEMPLARY EMBODIMENTS

Figure 1:
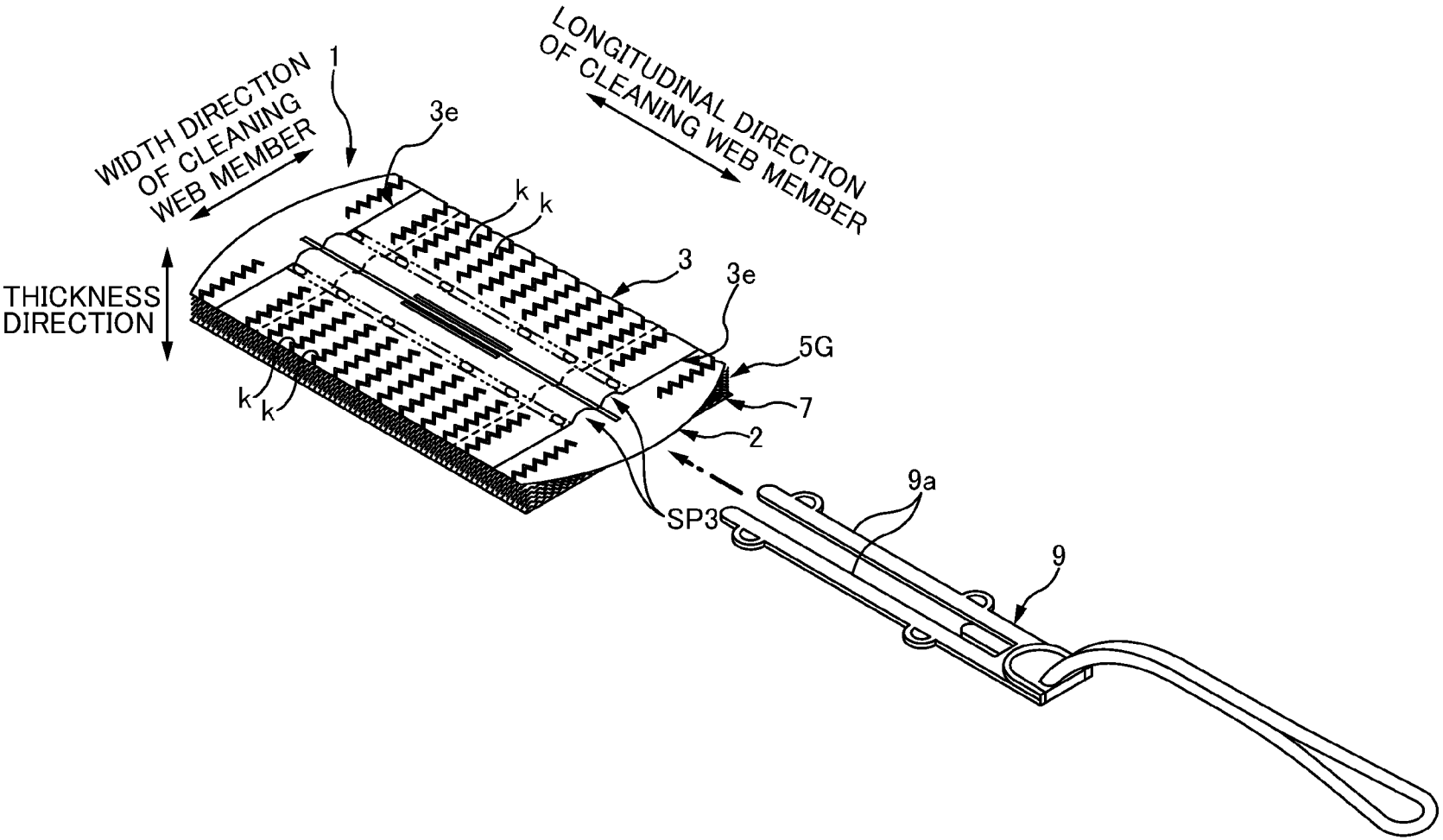
FIG. 1 is a perspective view of a cleaning web member 1.

A web-member cutting apparatus for cutting a web member at intervals in a transport direction, the web member having a plurality of fibers including tows along the transport direction and being continuous in the transport direction, the web-member cutting apparatus including:

an intermittent transport mechanism that intermittently transports the web member in the transport direction;

a disc-like rotatable blade member that cuts the web member by moving along an intersecting direction while rotating about a rotation shaft during a suspension period of transport of the web member, the intersecting direction intersecting the transport direction, the rotation shaft extending along the transport direction; and a downstream pressing member that regulates movement of the web member by pressing the web member against the intermittent transport mechanism at a position downstream from a target cut position in the transport direction throughout a period during which the rotatable blade member is cutting the web member.

With this web member cutting apparatus, the web member is cut along the intersecting direction by rotating and moving the rotatable blade member in the intersecting direction. Accordingly, the web member can be reliably cut by simply bringing the rotatable blade member into contact with the web member. As a result, the rotatable blade member does not require a receiver blade against which the web member is to be pressed by the rotatable blade member during cutting. This can reliably prevent tows from being attached at a target cut position by welding or compression-bonding, which may occur during pressing.

Furthermore, since a receiver blade is not required, the cutting edge of the rotatable blade member is brought into contact only with the web member during cutting. This can suppress wear of the rotatable blade member.

Furthermore, at the time of cutting, the pressing member presses the web member against the intermittent transport mechanism at a position downstream in the transport direction from a target cut position of the web member; at this stage, the intermittent transport mechanism suspends its transport operation. Thus, the movement of the web member is regulated. This makes it possible to effectively prevent disordered movement of the web member such as wobbling of the web member due to contact of the web member with the rotatable blade member that moves in the intersecting direction while rotating. Thus, a good cutting performance can be ensured.

Furthermore, fibers such as tows which have already been cut are in contact with the blade faces of the disc-like rotatable blade member throughout a period from when cutting of the fibers is just started to when the web member is completely cut by the rotatable blade member. Due to rotation of the blade faces, fibers are spread and loosened in the thickness direction and the like of the web member. This can achieve high softness and bulkiness of fibers near a cut position in the web member. As a result, the cut sheet-like product of the web member formed by cutting can have high bulkiness.

In such a web-member cutting apparatus, it is desirable that the intersecting direction along which the rotatable blade member moves is a width direction of the web member.

With this web member cutting apparatus, the intersecting direction related to the movement direction of the rotatable blade member is not the thickness direction of the web member but the width direction of the web member. Accordingly, the size of the rotatable blade member can be reduced. That is to say, if the web member is cut by moving the rotatable blade member in the thickness direction of the web member, it is necessary to use a rotatable blade member having a diameter at least larger than the size of the web member in the width direction, which results in inevitable increase in the size of the rotatable blade member. However, this problem can be avoided by applying the configuration in which the rotatable blade member is moved in the width direction of the web member.

In such a web-member cutting apparatus, it is desirable that the rotatable blade member is guided so as to be reciprocally movable in the width direction, and that a moving operation of the rotatable blade member along the width direction during a suspension period of transport of the web member is performed in a direction opposite a direction of a moving operation of the rotatable blade member during a suspension period immediately before the period.

With this web member cutting apparatus, the cutting operation by the rotatable blade member is performed as bidirectional cutting in which the web member is cut in both the forward path and the return path of reciprocal movement of the rotatable blade member along the width direction. This can increase the number of times the web member is cut per unit time. Thus, productivity is improved.

In such a web-member cutting apparatus, it is desirable that the web-member cutting apparatus further comprises an upstream pressing member that regulates movement of the web member by pressing the web member against the intermittent transport mechanism at a position upstream from the target cut position in the transport direction throughout a period during which the rotatable blade member is cutting the web member.

With this web member cutting apparatus, the web member is pressed not only at the downstream position but also the upstream position. That is, on both sides in the transport direction of a target cut position, the web member is pressed by the intermittent transport mechanism whose transport is suspended. Accordingly, the movement of the web member during cutting is reliably regulated. This further improves the cutting performance for the web member.

In such a web-member cutting apparatus, it is desirable that the intermittent transport mechanism includes an upstream belt conveyor that is disposed upstream in the transport direction from the rotatable blade member and a downstream belt conveyor that is disposed downstream in the transport direction from the rotatable blade member, and during a suspension period of transport of the web member, a predetermined portion of the downstream pressing member is in a pressing state in which the predetermined portion is in contact with the web member and in which the predetermined portion presses the web member against a transport surface of the downstream belt conveyor, and that during a period of transport of the web member, the predetermined portion is in a withdrawn state in which the predetermined portion is located at a greater distance from the transport surface of the downstream belt conveyor than the position of the predetermined portion in the pressing state is.

With this web member cutting apparatus, the downstream pressing member during transport of the web member is in a withdrawn state in which the downstream pressing member is located at a greater distance from the downstream belt conveyor than in the pressing state. This makes it possible to maintain high softness and bulkiness of the fibers such as tows without being impaired during transport after cutting; the softness and bulkiness being provided due to contact with the rotating blade faces of the rotatable blade member. As a result, it is possible to reliably produce a cut sheet-like product of the web member having high bulkiness by cutting.

In such a web-member cutting apparatus, it is desirable that the downstream pressing member includes an endless belt member that is disposed at a position where the web member is sandwiched between the endless belt member and the downstream belt conveyor, that the endless belt member is intermittently driven and revolves in conjunction with an intermittent transport operation by the downstream belt conveyor, that the endless belt member is pivotally supported so as to oscillate about a rotation shaft along a width direction of the web member, that an upstream end portion of the endless belt member in the transport direction is the predetermined portion, and that the pressing state and the withdrawn state of the upstream end portion are alternately switched through an oscillation operation of the endless belt member.

With this web member cutting apparatus, the endless belt member serving as the pressing member is intermittently driven to circumferentially revolve in conjunction with the intermittent transport operation by the downstream belt conveyor. Thus, a cut sheet-like product made of the web member which has been formed by cutting is quickly transported to the subsequent process without being stopped at its position. This can previously prevent problems in the manufacture.

Furthermore, since the pressing state and the withdrawn state are switched through the oscillation operation. Therefore, the response of the switching motion becomes better. As a result, a series of processes including the cutting and the intermittent transport can be performed at high speed.

In such a web-member cutting apparatus, it is desirable that during a period of transport of the web member, a downstream end portion of the endless belt member is located at a greater distance from the transport surface of the downstream belt conveyor than the upstream end portion is.

With this web member cutting apparatus, the endless belt member is disposed so that a space between the endless belt member and the downstream belt conveyor becomes wider toward the downstream side in the transport direction. Accordingly, this can effectively prevent the cut sheet-like product from being caught on the endless belt member even when the volume of the cut sheet-like product of the web member formed by cutting is recovered during transport to increase the thickness of the web member.

In such a web-member cutting apparatus, it is desirable that a cut sheet-like product formed by cutting the web member is used for cleaning, and that the web member is transported in a state in which an opposite face of a face which is to be a wiping face during cleaning is in contact with a transport surface of the intermittent transport mechanism.

With this web member cutting apparatus, the transport surface is not in contact with a face of the web member which is to be a wiping face during cleaning. This makes it easier to maintain high bulkiness of fibers on the face which is to be the wiping face. As a result, the wiping face of the cleaning web member can have high bulkiness.

In such a web-member cutting apparatus, it is desirable that a position of the rotation shaft of the rotatable blade member is offset from a center position of the web member in a thickness direction of the web member.

With this web member cutting apparatus, the movement direction of the cutting edge of the rotatable blade member at a position where it is in contact with the web member at the onset of cutting is slanted with respect to the thickness direction of the web member. Thus, a good cutting performance can be achieved at the onset of cutting.

In such a web-member cutting apparatus, it is desirable that while the web member is being cut at the target cut position, tows that are located at the target cut position and have already cut are spread and loosened in a thickness direction of the web member by a blade face of the rotatable blade member being contact of with the tows.

With this web member cutting apparatus, the tows that are located at the target cut position and have already cut are in contact with the blade faces of the rotatable blade member. Thus, due to rotation of the blade faces, the tows are spread and loosened in the thickness direction and the like of the web member. This can achieve high softness and bulkiness of fibers near a cut position in the web member. As a result, it is possible to reliably produce a cut sheet-like product of the web member having high bulkiness by cutting.

Further, a method for cutting a web member at intervals in a transport direction, the web member having a plurality of fibers including tows along the transport direction and being continuous in the transport direction, the method including:

intermittently transporting the web member in the transport direction;

cutting the web member by moving a disc-like rotatable blade member along an intersecting direction with the rotatable blade member rotating about a rotation shaft during a suspension period of transport of the web member, the intersecting direction intersecting the transport direction, the rotation shaft extending along the transport direction; and regulating movement of the web member by pressing the web member against the intermittent transport mechanism at a position downstream from a target cut position in the transport direction throughout a period during which the rotatable blade member is cutting the web member.

With this method, the web member is cut along the intersecting direction by moving the rotatable blade member along the intersecting direction while rotating the rotatable blade member. Accordingly, the web member can be reliably cut by simply bringing the rotatable blade member into contact with the web member. As a result, the rotatable blade member does not require a receiver blade against which the web member is to be pressed by the rotatable blade member during cutting. This can reliably prevent tows from being attached at a target cut position by welding or compression-bonding, which may occur during pressing.

Furthermore, since a receiver blade is not required, the cutting edge of the rotatable blade member is brought into contact only with the web member during cutting. This can suppress wear of the rotatable blade member.

Furthermore, at the time of cutting, the pressing member presses the web member against the intermittent transport mechanism at a position downstream in the transport direction from a target cut position of the web member; at this stage, the intermittent transport mechanism suspends its transport operation. Thus, the movement of the web member is regulated. This makes it possible to effectively prevent disordered movement of the web member such as wobbling of the web member due to contact of the web member with the rotatable blade member that rotates while moving in the intersecting direction. Thus, a good cutting performance can be ensured.

Furthermore, fibers such as tows which have already been cut are in contact with the blade faces of the disc-like rotatable blade member throughout a period from when cutting of the fibers is just started to when the web member is completely cut by the rotatable blade member. Due to rotation of the blade faces, fibers are spread and loosened in the thickness direction and the like of the web member. This can achieve high softness and bulkiness of fibers near a cut position in the web member. As a result, the cut sheet-like product of the web member formed by cutting can have high bulkiness.

=First Embodiment=

Figure 2A:
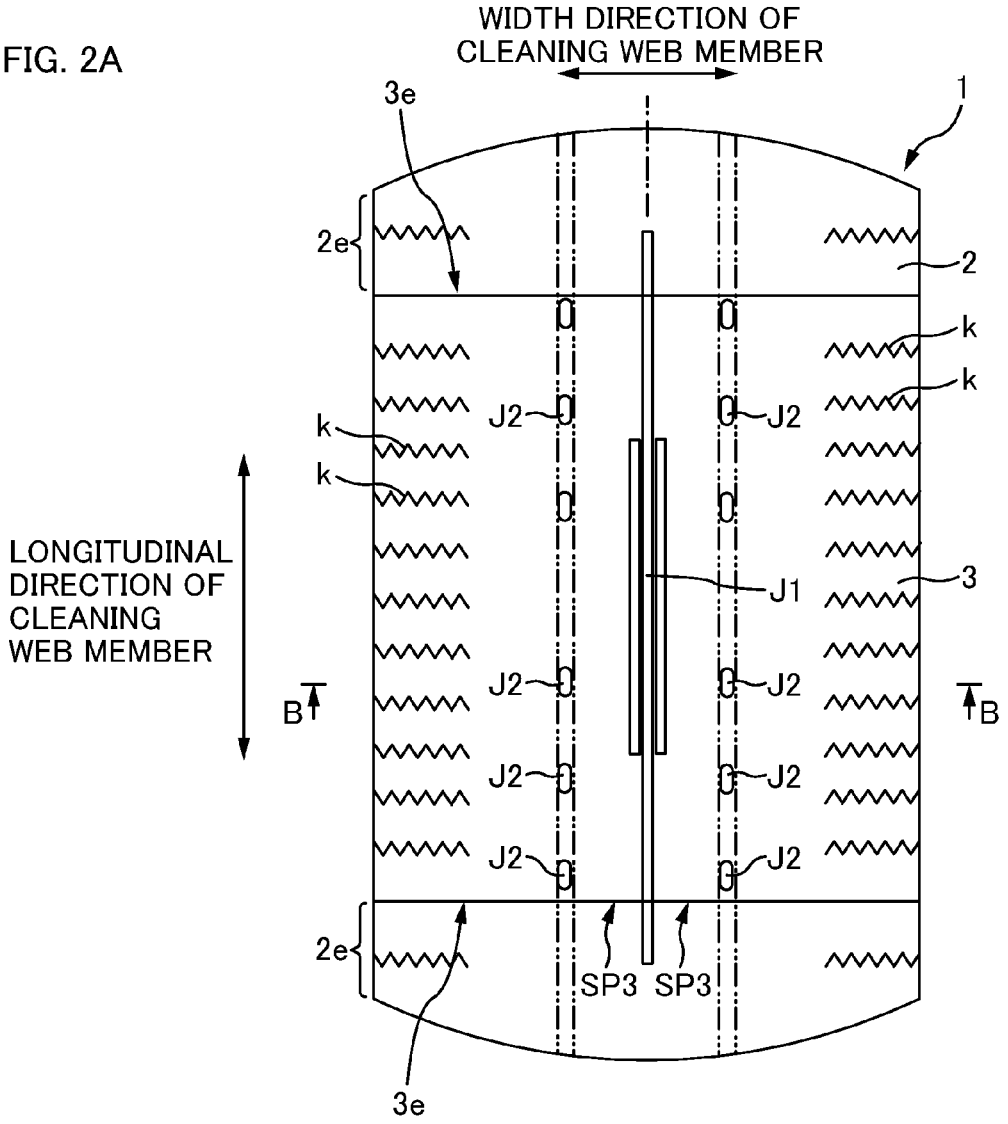
FIG. 2A is a plan view of the cleaning web member 1.

FIG. 1 is a perspective view of a cleaning web member 1 formed by cutting using a cutting apparatus 10 of the first embodiment. FIG. 2A is a plan view thereof, and FIG. 2B is a cross-sectional view taken along line B-B in FIG. 2A.

As shown in FIGS. 1 and 2A, the cleaning web member 1 (corresponding to a cut sheet-like product) is substantially in the shape of a rectangle having a longitudinal direction and a width direction when viewed from above. Furthermore, as shown in FIGS. 1 and 2B, in the thickness direction, the cleaning web member 1 includes: a base sheet 2; an auxiliary sheet 3 that covers the top surface of the base sheet 2, a fiber bundle member 5G that covers the bottom surface of the base sheet 2 and forms a main brush section, and a strip sheet 7 that is placed on the bottom surface of the fiber bundle member 5G and forms an auxiliary brush section. Here, hollows SP3 and SP3 into which a handle member 9 is inserted and secured are formed between the auxiliary sheet 3 and the base sheet 2. Insertion sections 9*a* and 9*a* of a fork-shaped part of the handle member 9 are inserted into the hollows SP3 and SP3, and the bottom surface and both end faces in the width direction of the cleaning web member 1 is used as wiping surfaces. Thus, the cleaning web member 1 is used for cleaning of a tabletop and the like.

Figure 2B:
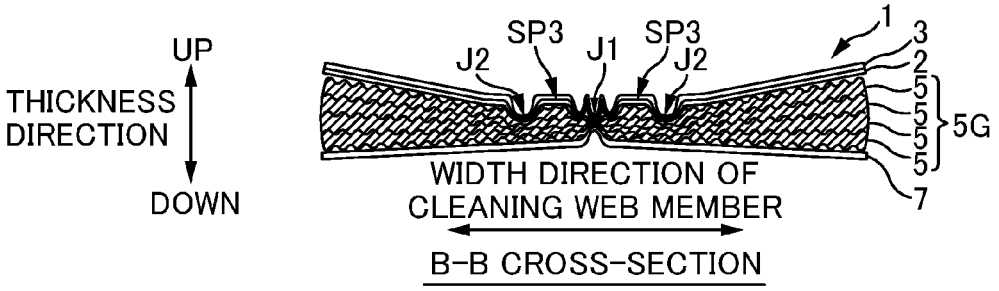
FIG. 2B is a cross-sectional view taken along line B-B in FIG. 2A.

As shown in FIG. 2B, the fiber bundle member 5G is a member having a plurality of fiber bundles 5 stacked in the thickness direction. Although four fiber bundles 5 are stacked in the thickness direction to form a four-layer structure in this example as an example of the plurality of fiber bundles, but the number of the fiber bundles 5 is not limited to this.

Each of the fiber bundles 5 has tows having a size of 3.5 dtex (a diameter of 18 to 25 μm) as a number of continuous fibers. However, the size of the tows is not limited to 3.5 dtex. For example, any value may be selected from the range of 1.1 to 10 dtex (a diameter of about 6 to 60 μm). Further, the fiber bundles 5 may each have tows having a plurality of sizes within the range of 1.1 to 10 dtex.

The tows are along the width direction of the cleaning web member 1. That is to say, the fiber direction of the tows (the longitudinal direction of each tow) is along the width direction of the cleaning web member 1. Accordingly, both end portions in the width direction basically serves as tip portions of the brush section. Note that, since these tows can be flexibly bent, the tip portions of the tows bend toward the bottom surface of the cleaning web member 1. This enables the bottom surface to also serve as a tip portion of the brush section. In this example, all fibers of the fiber bundles 5 are tows, but the invention is not limited thereto. That is to say, the fiber bundles 5 may contain fibers other than tows.

Note that tows refer to fibers made of continuous filaments, and examples thereof include: single fibers such as polyethylene terephthalate (PET), polypropylene (PP), or polyethylene (PE); composite fibers of a core-sheath structure such as a PE sheath and a PET core or a PE sheath and a PP core; and side-by-side composite fibers such as PE/PET or PE/PP. Note that the fibers may have a cross-section in the shape of a circle or other shapes. Note that the fibers may have crimps. In that case, crimping is performed during manufacture of the filaments, and the number of crimps is increased by a preheated calendar or under a hot-air treatment. The crimped tows are transferred by a transfer roll, and, at that time, a tensile force is applied in the longitudinal direction of the filaments and is then released. By repeating this processing, the continuous filaments of the tows are opened so as to be each independently separated.

As shown in FIGS. 1, 2A, and 2B, both of the base sheet 2 and the auxiliary sheet 3 are sheets substantially in the shape of rectangles when viewed from above. Although the base sheet 2 and the auxiliary sheet 3 have the same size in the width direction, the base sheet 2 is longer than the other in the longitudinal direction. Accordingly, when the auxiliary sheet 3 is stacked on the base sheet 2, both longitudinal end portions 2*e* and 2*e* of the base sheet 2 project outward by a predetermined length from both longitudinal ends 3*e* and 3*e* of the auxiliary sheet 3.

Furthermore, in this example, both of the base sheet 2 and the auxiliary sheet 3 have zigzag cuts k, k, . . . in end portions in the width direction, the zigzag cuts k, k, . . . being formed along the width direction with spacing in the longitudinal direction. With these cuts k, k, . . . , a plurality of zigzag strips extending along the width direction are formed on the ends of the base sheet 2 and the auxiliary sheet 3 in the width direction. However, the cuts k, k, . . . are not essential.

The base sheet 2 and the auxiliary sheet 3 are formed by a nonwoven fabric containing thermoplastic fibers, for example. Examples of the thermoplastic fibers include: PE fiber; PP fiber; PET fiber; composite fiber of PE and PET (e.g., composite fiber having a core-sheath structure of a PE core and a PET sheath); and composite fiber of PE and PP (e.g., composite fiber having a core-sheath structure of a PET core and a PE sheath). Examples of the form of the nonwoven fabric include: a thermal bond nonwoven fabric; a spunbond nonwoven fabric; and a spunlace nonwoven fabric. However, the material of the base sheet 2 and the auxiliary sheet 3 is not limited to the nonwoven fabric described above.

The strip sheet 7 is formed of a flexible sheet such as a nonwoven fabric containing thermoplastic fibers or a thermoplastic resin film, and is a substantially rectangular shape having approximately the same planar size as that of the base sheet 2. On the ends of the strip sheet 7 in the width direction, formed are zigzag cuts (not shown) along the width direction with spacing in the longitudinal direction. With these cuts, a plurality of zigzag strips (not shown) extending along the width direction are formed in the ends of the strip sheet 7 in the width direction. However, the strip sheet 7 is not essential.

The auxiliary sheet 3, the base sheet 2, the four fiber bundles 5 of the fiber bundle member 5G, and the strip sheet 7 are stacked in the thickness direction in this order; they are joined into one piece by forming a plurality of welded-bonded sections J1 and J2, as shown in FIGS. 2A and 2B.

For example, at the center position in the width direction, formed is the first welded-bonded section J1 having the shape of a straight line along the longitudinal direction. The first welded-bonded section J1 bonds, by welding, all layers in the thickness direction of the cleaning web member 1 (i.e., the entire structure of the auxiliary sheet 3, the base sheet 2, the four fiber bundles 5 of the fiber bundle member 5G, and the strip sheet 7).

Furthermore, at positions at a predetermined distance from both ends of the first welded-bonded section J1 in the width direction, formed are the plurality of island-like second welded-bonded sections J2, J2, . . . with spacing along the longitudinal direction. The second welded-bonded sections J2 are formed in order mainly to form the above-described hollows SP3 and SP3 in cooperation with the first welded-bonded section J1, the hollows SP3 and SP3 being for securing the handle member 9 between the auxiliary sheet 3 and the base sheet 2 by inserting into the hollows SP3 and SP3. Accordingly, as shown in FIG. 2B, on the second welded-bonded sections J2, bonded are the following components which are located on the upper side in the thickness direction: the auxiliary sheet 3, the base sheet 2, and two fiber bundles 5 and 5 located closer to the base sheet 2. On the other hand, the following components are not bonded: two fiber bundles 5 and 5 located on the lower side and the strip sheet 7 located below the fiber bundles 5. The welded-bonded sections J1, J2, J2, . . . are formed, for example, by ultrasonic welding.

Figure 3:
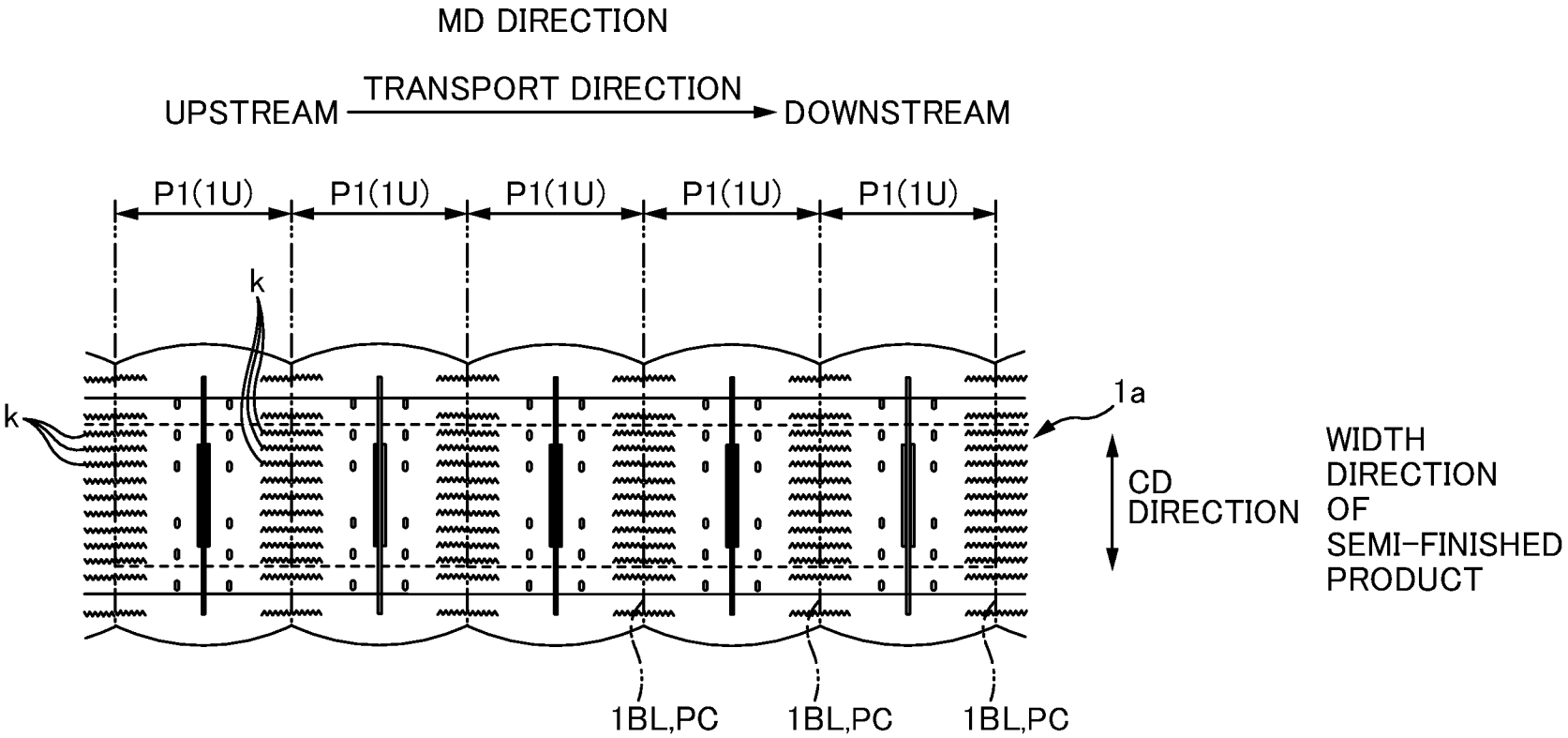
FIG. 3 is a schematic view of a semi-finished product la, which corresponds to the cleaning web members 1 that has not been cut yet.

The cleaning web member 1 is manufactured by cutting a continuous body into a product size with the cutting apparatus 10 that is installed usually for the final processing in the production line. FIG. 3 is a schematic view showing a state before cutting. At this stage, all constituent components 3, 2, 5, 5, 5, 5, and 7 of the cleaning web member 1 such as the base sheet 2 and the fiber bundle 5 have already been stacked and bonded by welding into one piece. But, these components have not been divided into individual cleaning web members 1; that is, they are in the form of a continuous body 1*a* in which portions 1U, 1U, . . . respectively corresponding to the cleaning web members 1, 1, . . . are continuously arranged along the transport direction in the production line. More specifically, the auxiliary sheet 3, the base sheet 2, and the strip sheet 7 are each in the form of a continuous sheet that is continuous in the transport direction. Furthermore, the fiber bundles 5 are also each in the form of a continuous body that is continuous in the transport direction.

Hereinafter, the continuous body 1*a* according to the cleaning web member 1 is referred to as a "semi-finished product 1*a*", and the portion 1U of the semi-finished product 1*a* corresponding to the cleaning web member 1 is referred to as a "semi-finished product unit 1U".

In this example, the semi-finished product 1*a* is transported in a so-called "transverse direction" flowing. That is to say, the semi-finished product 1*a* is transported in a state where the direction corresponding to the width direction of the cleaning web member 1, which is a product, is in the transport direction. Accordingly, cut edges formed by cutting the semi-finished product 1*a* at a product pitch P1 in the transport direction correspond to end edges in the width direction of the cleaning web member 1. As clearly described above, the fiber direction of the tows in the fiber bundles 5 in the semi-finished product 1*a* is along the transport direction. Thus, the tows are also cut when the semi-finished product 1*a* is cut at the product pitch P1.

Figure 4C:
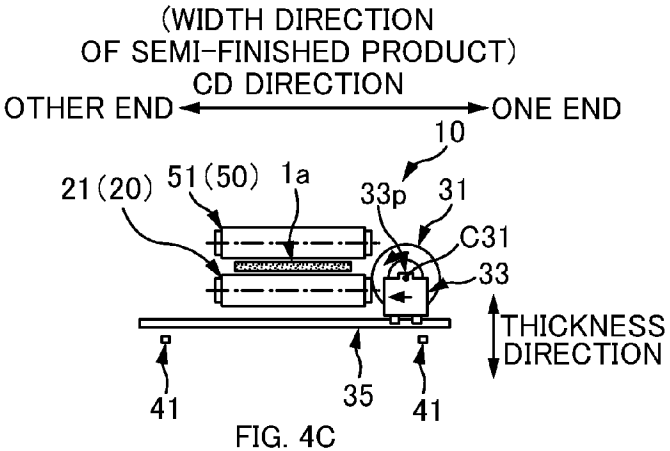
FIG. 4C is a view along arrows C-C in FIG. 4A.
Figure 4A:
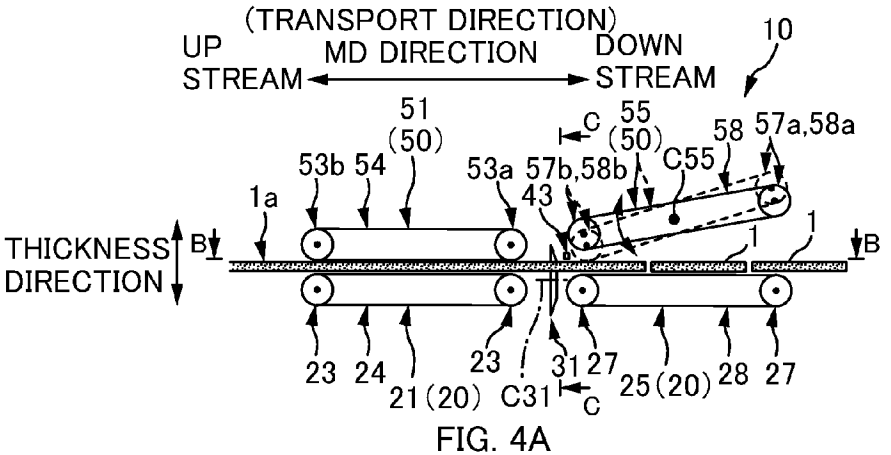
FIG. 4A is a schematic side view of a cutting apparatus 10 of a first embodiment.
Figure 4B:
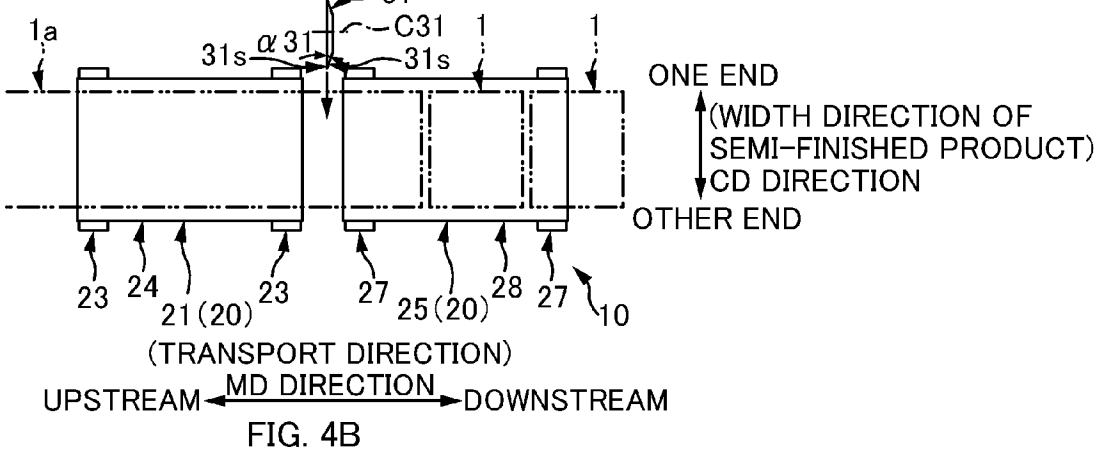
FIG. 4B is a view along arrows B-B in FIG. 4A.

Hereinafter, the cutting apparatus 10 will be described. In the description below, the width direction of the semi-finished product 1*a* is also referred to as a "CD direction", and, among two directions orthogonal to the CD direction, the direction in which the semi-finished product 1*a* is continuous is also referred to as an "MD direction". Note that the MD direction also matches the transport direction of the semi-finished product 1*a*. Furthermore, the thickness direction of the semi-finished product 1*a*, the CD direction, and the MD direction are orthogonal to each other. FIG. 4A is a schematic side view of the cutting apparatus 10 of the first embodiment, FIG. 4B is a view along arrows B-B in FIG. 4A, and FIG. 4C is a view along arrows C-C in FIG. 4A. Note that, in these and other drawings used for the following description, in order to avoid complications regarding the diagrams, portions in the configuration may be omitted as appropriate.

The cutting apparatus 10 includes: an intermittent transport mechanism that intermittently transports the semi-finished product 1*a* (corresponding to a web member); a rotatable blade 31 (corresponding to a rotatable blade member) that cuts the semi-finished product 1*a* when a transport of the semi-finished product 1*a* is suspended; a regulating member 50 that regulates movement of the semi-finished product 1*a* throughout the period during which the rotatable blade 31 is cutting the semi-finished product 1*a*; sensors 41 and 43 that monitor a state of the devices 20, 31, and 50 such as the intermittent transport mechanism 20; and a controller (not shown). The controller controls the operation of the devices, namely the intermittent transport mechanism 20, the rotatable blade 31, and the regulating member 50 based on a detection signal transmitted from the sensors 41 and 43 or the like. Thereby, the semi-finished product 1*a* is sequentially cut at the product pitch P1 into the single-cut cleaning web members 1.

The main body of the intermittent transport mechanism 20 is configured by two belt conveyors 21 and 25 that are arranged in the MD direction, for example. Specifically, one belt conveyor 21 is disposed at a position upstream in the MD direction from the installation position of the rotatable blade 31, and the other belt conveyor 25 is disposed at a position downstream in the MD direction from the installation position of the rotatable blade 31. Hereinafter, the former belt conveyor is referred to as an "upstream belt conveyor 21", and the latter belt conveyor is referred to as a "downstream belt conveyor 25".

The upstream belt conveyor 21 and the downstream belt conveyor 25 each include: a pair of rollers 23 and 23 (27 and 27) that are arranged in the MD direction; and an endless belt 24 (28) that is wrapped around the pair of rollers 23 and 23 (27 and 27). At least one roller 23 (27) of each pair of rollers 23 (27) is driven and rotated by a servomotor that serves as a driving source, and, thus, the semi-finished product 1*a* is transported downstream in the MD direction by the outer circumferential face of the endless belt 24 (28) as a transport surface. Note that the number of the rollers 23 (27) are not limited to two (a pair). For example, three rollers 23 (27) may be provided so as to move the endless belt 24 (28) along a path having a substantially triangular shape.

The two belt conveyors 21 and 25 perform substantially the same intermittent transport operation in conjunction with each other. Thus, the semi-finished product 1*a* quickly passes over the installation position of the rotatable blade 31 and is transported in the MD direction.

Suspension of the transport in the intermittent transport operation is performed by measuring the transport amount of the semi-finished product 1*a* using a rotation detection sensor such as a rotary encoder. The rotation detection sensor is provided on any one of the rollers 23 and 27 of the belt conveyors 21 and 25, for example. The rotation detection sensor repeatedly outputs a signal indicative of a rotational angle value of 0° to 360°, and the rotational angle value of 0° to 360° is allocated to a transport amount corresponding to one semi-finished product unit 1U, which is the product pitch P1. The transport is suspended when a rotational angle value that matches a target rotational angle value is output. Here, the target rotational angle value is predetermined, for example, so that a target cut position PC in the semi-finished product 1*a* substantially matches the installation position of the rotatable blade 31 in the MD direction at the time of the suspension; the target cut position PC is a boundary position 1BL (FIG. 3) between the semi-finished product units 1U and 1U that are adjacent to each other in the MD direction. Accordingly, the semi-finished product 1*a* is cut substantially at the boundary position 1BL between the semi-finished product units 1U. Here, it is possible to use a CCD camera or the like for measuring a displacement amount of the semi-finished product 1*a* from the target stop position at the time of the suspension and it is possible to correct the target rotational angle value based on this displacement amount. Note that the transport is restarted, for example, in cooperation with the regulating member 50, which will be described later.

The rotatable blade 31 has a main body configured by a disc-like plate having a perfectly circular shape, and a sharp cutting edge is formed throughout the entire outer circumferential edge portion thereof. The rotatable blade 31 coaxially includes a rotation shaft C31 in an integrated manner. The rotation shaft C31 is along the MD direction and is supported on a support platform 33 with means such as a bearing (not shown). Furthermore, the support platform 33 is provided with a motor (not shown) as a driving source that drives and rotates the rotatable blade 31 about the rotation shaft C31. Accordingly, a rotational force of the motor is transmitted by an appropriate power transmission mechanism (not shown) such as an endless-belt power transmission device to the rotatable blade 31. Thus, the rotatable blade 31 is continuously driven and rotated in one direction at a certain circumferential velocity.

The rotatable blade 31, together with the support platform 33 that supports the rotatable blade 31, is guided so as to be reciprocally movable in the CD direction (corresponding to an intersecting direction) along an appropriate guide member 35 such as a linear guide. The rotatable blade 31 is reciprocally moved in the CD direction by an appropriate drive mechanism (not shown). Each stroke distance in the forward path and the return path according to the reciprocal movement is set to a distance that allows the rotatable blade 31 to cross the semi-finished product 1*a* in the CD direction across the entire width. Furthermore, the drive mechanism (not shown) includes: for example, a pair of pulleys that are arranged in the CD direction; an endless timing belt that is wrapped around the pair of pulleys; and a servomotor as a driving source that rotates the pulleys. Part of the endless timing belt is secured to the support platform 33. Accordingly, when the servomotor repeatedly rotates clockwise and anti-clockwise, the rotatable blade 31 is reciprocally moved in the CD direction. With such a rotatable blade 31, during a suspension period of transport of the semi-finished product 1*a*, the rotatable blade 31 moves from one side to the other side in the CD direction or moves from the other side to the one side while being driven and rotated about the rotation shaft C31. The cutting edge of the rotatable blade 31 that is being driven and rotated cuts the semi-finished product 1*a* during the movement. Hereinafter, in the reciprocal movement, the movement from the one side to the other side is referred to as a "forward-path movement", and the movement from the other side to the one side, which is movement in the opposite direction, is referred to as a "return-path movement".

Here, proximity switches 41 and 41 are provided respectively near the ends of the blade stroke on the one side and the other side in the CD direction. When the rotatable blade 31 has moved across the semi-finished product 1*a* in the CD direction and arrived at either of the ends, the proximity switches 41 and 41 detect the arrival and output a detection signal. The detection signal output from the sensors 41 is used for controlling the regulating member 50, which will be described later.

The regulating member 50 includes: an upstream pressing member 51 that is disposed corresponding to the upstream belt conveyor 21; and a downstream pressing member 55 that is disposed corresponding to the downstream belt conveyor 25. Throughout the period during which the semi-finished product 1*a* is being cut, the upstream pressing member 51 presses the semi-finished product 1*a* against the upstream belt conveyor 21, at a position upstream from the rotatable blade 31 in the MD direction. Furthermore, throughout the period during which the semi-finished product 1*a* is being cut, the downstream pressing member 55 presses the semi-finished product 1*a* against the downstream belt conveyor 25 at a position downstream from the rotatable blade 31 in the MD direction (see the state indicated by the broken line in FIG. 4A). Accordingly, the movement of the semi-finished product 1*a* during cutting is effectively regulated. Thus, the stability in the cutting operation is improved, which results in achievement of a good cutting performance.

The upstream pressing member 51 includes: a pair of rollers 53*a* and 53*b* that are arranged in the MD direction; and an endless belt 54 that is wrapped around the pair of rollers 53*a* and 53*b*. The endless belt 54 is disposed so that its outer circumferential face opposes the outer circumferential face of the endless belt 24 of the upstream belt conveyor 21 functioning as a transport surface. These endless belts 24 and 54 gently presses from both sides in the thickness direction the semi-finished product 1*a* that is positioned between the outer circumferential faces of the endless belts. The endless belt 54 of the upstream pressing member 51, in conjunction with the intermittent transport operation by the upstream belt conveyor 21, performs a revolving operation intermittently in the same operation pattern as this intermittent transport operation. Accordingly, the semi-finished product 1*a* is stably transported in the MD direction intermittently by the transport amount corresponding to the product pitch P1; whereas, when the rotatable blade 31 cuts the semi-finished product 1*a* during a transport suspension, the movement of the semi-finished product 1*a* is effectively regulated at a position upstream from the rotatable blade 31 in the MD direction. Thus, a good cutting performance is achieved. The revolving operation of the upstream pressing member 51 in conjunction with this intermittent transport operation is realized, for example, by obtaining the driving force of the revolving operation from the servomotor that serves as the driving source for the upstream belt conveyor 21, via an appropriate power transmission mechanism such as a gear train or an endless-belt power transmission device. However, the invention is not limited thereto. For example, an additional servomotor may be provided for driving the revolving operation of the upstream pressing member 51, and this servomotor may be controlled in synchronization with the intermittent transport operation of the upstream belt conveyor 21.

Meanwhile, as in the upstream pressing member 51 described above, the downstream pressing member 55 also includes: a pair of rollers 57*a* and 57*b* that are arranged in the MD direction; and an endless belt 58 that is wrapped around the pair of rollers 57*a* and 57*b* (corresponding to an endless belt member). The endless belt 58 is disposed so that its outer circumferential face opposes the outer circumferential face of the endless belt 28 of the downstream belt conveyor 25 functioning as a transport surface. However, the endless belt 58 of the downstream pressing member 55 is supported so as to oscillate about a shaft C55 along the CD direction as the center of the oscillation. At the time of cutting during a transport suspension, counterclockwise revolution of the endless belt 58 shown in FIG. 4A brings an upstream end portion 58*b* (corresponding to a predetermined portion or an upstream end portion) of the endless belt 58 into contact with the semi-finished product 1*a* as indicated by the broken line in FIG. 4A, the upstream end portion 58*b* being located upstream in the MD direction. Thus, the semi-finished product 1*a* is pressed against the outer circumferential face of the endless belt 28 of the downstream belt conveyor 25. Accordingly, the movement of the semi-finished product 1*a* during cutting is regulated also at a position downstream from the rotatable blade 31, and a good cutting performance is ensured. On the other hand, clockwise revolution of the endless belt 58 shown in FIG. 4A during transport makes the upstream end portion 58*b* of the endless belt 58 become in a withdrawn state as indicated by the solid line in FIG. 4A, in which it is located at a greater distance from the endless belt 28 of the downstream belt conveyor 25 than in the above-described pressing state (the state indicated by the broken line). This enlarges the space between the downstream belt conveyor 25 and the downstream pressing member 55, which can prevent the semi-finished product 1*a* from being caught during transport.

Although not shown, as an example of the drive mechanism for this oscillation operation, provided is a configuration including: a servomotor that serves as a driving source; and a motion converting mechanism such as a crank mechanism that converts rotational motion of a rotation shaft of the servomotor into reciprocal motion and transmits it to the downstream pressing member 55. This configuration is adopted in this example, but the invention is not limited thereto. Furthermore, in this example, in order to detect a pressing state, a proximity switch 43 is provided near a position where the downstream pressing member 55 in the pressing state is located. A detection signal from the proximity switch 43 is used as a trigger signal for starting the moving operation of the rotatable blade 31 in the CD direction, which will be described later.

Furthermore, the endless belt 58 of the downstream pressing member 55 performs an intermittent revolving operation in conjunction with the intermittent transport operation by the downstream belt conveyor 25; the operation pattern of the intermittent revolving operation is substantially the same as that of the intermittent transport operation. This can more reliably prevent such a problem that the semi-finished product 1*a* is caught on the endless belt 58 of the downstream pressing member 55 during transport. The revolving operation of the endless belt 58 of the downstream pressing member 55 is performed by a servomotor, serving as a driving source, provided for at least one of the pair of rollers 57*a* and 57*b*. The servomotor is controlled by a controller. For example, the controller controls the servomotor based on outputs from a rotation detection sensor provided for any of the rollers 23 and 27 of the intermittent transport mechanism 20, the rotation detection sensor being a device such as a encoder. Accordingly, the intermittent revolving operation of the endless belt 58 of the downstream pressing member 55 is realized in conjunction with the above-described intermittent transport operation.

Furthermore, in the example in FIG. 4A, also during transport of the semi-finished product 1*a*, the outer circumferential face of the endless belt 58 of the downstream pressing member 55 is maintained in a inclined state with respect to the outer circumferential face of the endless belt 28 of the downstream belt conveyor 25 (see the state indicated by the solid line in FIG. 4A). That is to say, in the endless belt 58 of the downstream pressing member 55, a downstream end portion 58*a* is located at a greater distance from the outer circumferential face of the downstream belt conveyor 25 than the upstream end portion 58*b* is. Accordingly, also during transport, the space between the downstream belt conveyor 25 and the downstream pressing member 55 is maintained in a state where it becomes wider toward the downstream side in the MD direction. Accordingly, this can reliably prevent the cleaning web member 1 from being caught on the downstream pressing member 55 even when the volume of the cleaning web member 1 formed by cutting into a single-cut sheet shape is recovered during transport to increase the thickness of the cleaning web member.

The main body of the controller is a device such as a computer or a programmable logic controller (PLC); the main body has a processor and a memory. Here, the processor reads and executes a control program stored previously in the memory, thereby controlling servomotors so that the intermittent transport mechanism 20, the rotatable blade 31, and the regulating member 50 operate in conjunction with one another, the servomotors serving as driving sources for these components 20, 31, and 50. That is to say, the configuration of the controller described here includes not only the main body such as a computer or a PLC but also an amplifier for actually performing a positional control on the servomotors.

FIGS. 5A to 5G are schematic diagrams showing how the single-cut cleaning web members 1 is produced by the cutting apparatus 10 cutting the semi-finished product 1*a* under the control of this controller. In each drawing, the upper portion shows a schematic side view corresponding to FIG. 4A, and the lower portion shows a schematic plan view corresponding to FIG. 4B.

In the cutting apparatus 10, as described above, during an suspension of the transport operation which is intermittently performed, the rotatable blade 31 performs alternatively either of the forward path operation or the return path operation in the CD direction so as to sequentially cut and separate the semi-finished product unit 1U at the downstream end of the semi-finished product 1*a*. Thus, the cleaning web members 1 is formed. Note that a series of cutting processes related to the forward path operation are the same as a series of cutting processes related to the return path operation except that the rotatable blade 31 moves in opposite directions along the CD direction. Accordingly, hereinafter, only a series of cutting processes related to the forward path operation will be described.

Figure 5A:
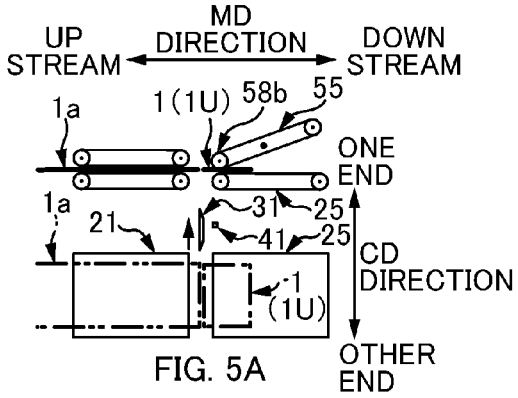
FIGS. 5A to 5G are schematic diagrams showing how the single-cut cleaning web members 1 are produced by the cutting apparatus 10 cutting the semi-finished product 1*a*.

FIG. 5A shows an initial state, which is a state immediately after the rotatable blade 31 has performed a return path operation. That is to say, the rotatable blade 31 has crossed the semi-finished product 1*a* in the CD direction and is positioned at the one side end in the CD direction. With this crossing, the semi-finished product unit 1U at the most downstream end of the semi-finished product 1*a* has been separated by cutting, and the single-cut cleaning web member 1 is formed.

Note that, at this stage, the upstream end portion 58*b* of the downstream pressing member 55 is still pressing the cleaning web member 1 against the downstream belt conveyor 25. If the semi-finished product 1*a* is transported in the MD direction in this state, this may cause such a trouble that the semi-finished product 1*a* is caught on the upstream end portion 58*b* of the downstream pressing member 55, which makes it difficult for the semi-finished product 1*a* to be transferred to the downstream belt conveyor 25.

Figure 5E:
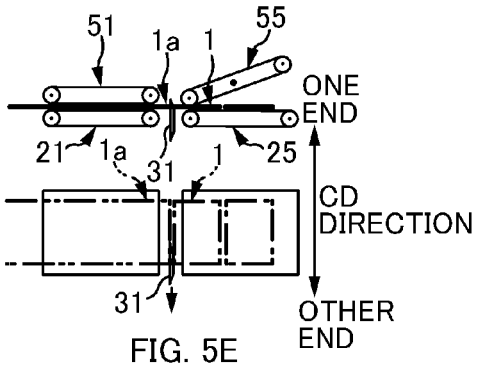
Figure 5B:
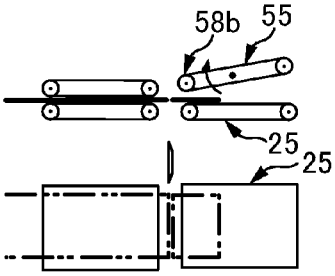

Accordingly, when the controller receives from the proximity switch 41 provided at the one side end in the CD direction a detection signal indicating that the rotatable blade 31 has reached this end, the controller causes the downstream pressing member 55 to rotate clockwise as shown in FIG. 5B. Thereby, the upstream end portion 58*b* moves away from the downstream belt conveyor 25, and reaches a withdrawn state in which the space between the upstream end portion 58*b* of the downstream pressing member 55 and the downstream belt conveyor 25 has enlarged.

Then, at the same time as a command of the clockwise rotational movement is output to the downstream pressing member 55 or when a predetermined time has elapsed after the output, the controller controls the upstream belt conveyor 21 and the downstream belt conveyor 25 which serve as the intermittent transport mechanism 20. Thereby, the semi-finished product 1*a* is transported by an amount corresponding to one semi-finished product unit 1U, which is the product pitch P1 (see FIG. 5C). Here, during this transport, as described above, the endless belt 54 of the upstream pressing member 51 performs the revolving operation in conjunction with the intermittent transport mechanism 20. The downstream pressing member 55 performs the above-described withdrawal operation and the endless belt 58 thereof revolves in conjunction with the intermittent transport mechanism 20. Accordingly, This makes it possible to reliably avoid a situation in which the pressing members 51 and 55 obstruct the transport operation. Furthermore, in this example, the transport operation of the semi-finished product 1*a* is controlled so as to start in association with the output of a command for the clockwise rotational movement to the downstream pressing member 55. Thus, the series of cutting processes is performed at high speed, but the invention is not limited thereto. For example, it is also acceptable that an appropriate sensor such as a proximity switch is used to detect an event in which the downstream pressing member 55 has withdrawn to a predetermined position and based on this detection the transport operation is started.

Figure 5F:
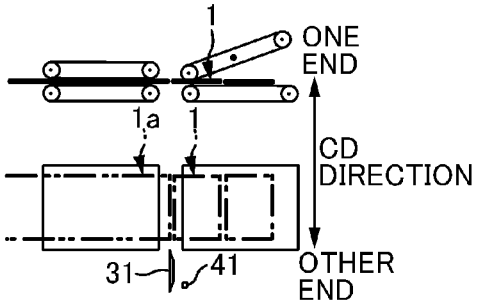
Figure 5C:
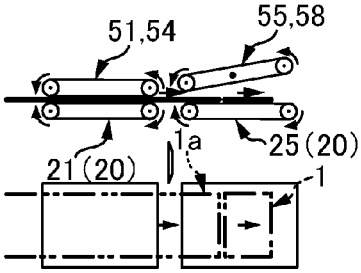
Figure 5G:
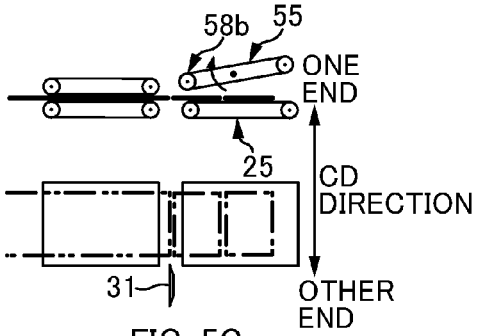
Figure 5D:
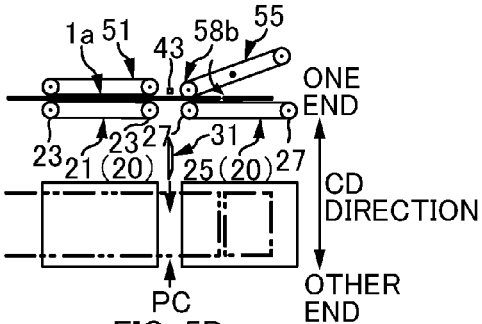

When the semi-finished product 1*a* has been transported by an amount corresponding to one semi-finished product unit 1U as described above, the controller suspends the transport. Then, the controller receives, for example, from a rotation detection sensor (not shown) such as an encoder provided for any of the rollers 23 and 27 of the intermittent transport mechanism 20, a detection signal indicating that the rotation of the rollers 23 (or 27) has been stopped. Then, the controller causes the downstream pressing member 55 to rotate counterclockwise as shown in FIG. 5D during this transport suspension. Thereby, the upstream end portion 58*b* moves toward the downstream belt conveyor 25, and reaches a state in which the upstream end portion 58*b* presses the semi-finished product 1*a* against the downstream belt conveyor 25.

A detection signal indicating that the downstream pressing member 55 is in the pressing state is transmitted to the controller from the proximity switch 43 near which the downstream pressing member 55 in the pressing state is located, for example. When the controller receives this detection signal, the controller moves the rotatable blade 31 in the CD direction from the one side end to the other side end as shown in FIGS. 5D to 5F, so that the cutting edge of the rotatable blade 31 cuts the semi-finished product 1*a*.

Here, as described above, the cutting is performed by the rotatable blade 31 moving in the CD direction while being driven and rotated about its center. Accordingly, a good cutting performance can be achieved. Furthermore, since a good cutting performance is achieved, the rotatable blade 31 does not have a receiver blade against which the semi-finished product 1*a* is to be pressed by the rotatable blade 31 during cutting. This can reliably prevent tows from being attached at the target cut position PC by welding or compression-bonding, which may occur during pressing. Furthermore, since a receiver blade is not provided, the cutting edge of the rotatable blade 31 is brought into contact only with the semi-finished product 1*a* during cutting. This can suppress wear of the rotatable blade 31.

Furthermore, as shown in FIGS. 5D and 5E, at the time of cutting, the upstream pressing member 51 presses the semi-finished product 1*a* against the upstream belt conveyor 21 at a position upstream in the MD direction from the target cut position PC; at this stage, the upstream belt conveyor 21 suspends its transport operation, Furthermore, the downstream pressing member 55 presses the semi-finished product 1*a* against the downstream belt conveyor 25 at a position downstream in the MD direction from the target cut position PC; at this stage, the downstream belt conveyor 25 suspends its transport. Thus, the movement of the semi-finished product 1*a* during the cutting is reliably regulated. This makes it possible to effectively prevent disordered movement of the semi-finished product 1*a* such as wobbling of the semi-finished product 1*a* due to contact of the semi-finished product 1*a* with the rotatable blade 31 that moves in the CD direction while being driven and rotated. This also contributes to ensuring a good cutting performance.

Then, a detection signal indicating that the rotatable blade 31 has reached this end is transmitted to the controller from the above-described proximity switch 41 provided at the other side end in the CD direction. When the controller receives this detection signal, the controller causes the downstream pressing member 55 to rotate clockwise as shown in FIG. 5G. Thereby, the upstream end portion 58*b* moves away from the downstream belt conveyor 25, and reaches a withdrawn state in which the space between the upstream end portion 58*b* of the downstream pressing member 55 and the downstream belt conveyor 25 has enlarged.

Here, the withdrawn state in FIG. 5G is substantially the same as the withdrawn state described with reference to FIG. 5B. Accordingly, the series of cutting processes related to the forward path operation finish at this stage. Subsequently, a series of cutting processes related to the return path operation are performed. Thereafter, the cutting processes according to the forward path operation and the cutting processes according to the return path operation are alternately repeated. Thus, a large number of cleaning webs 1 are produced from the semi-finished product 1*a*.

Figure 6A:
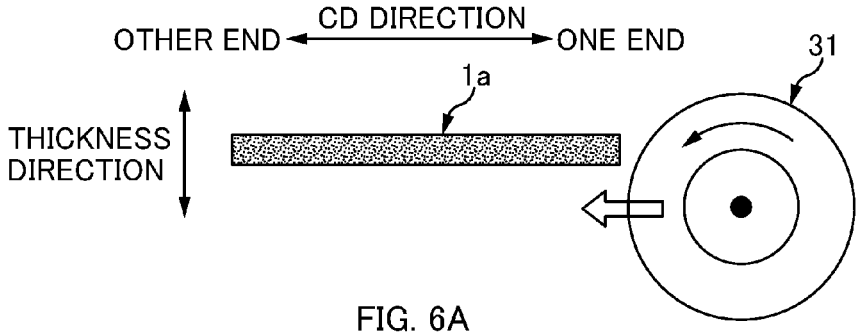
FIGS. 6A to 6C are explanatory diagrams showing how the rotatable blade 31 causes the fiber bundles 5 of tows to have high bulkiness at the same time as the cutting operation.
Figure 6B:
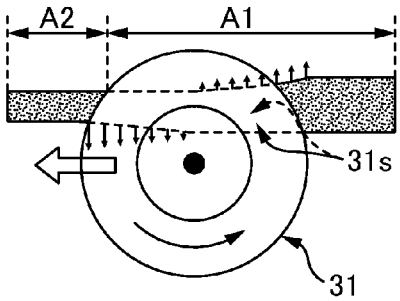
Figure 6C:
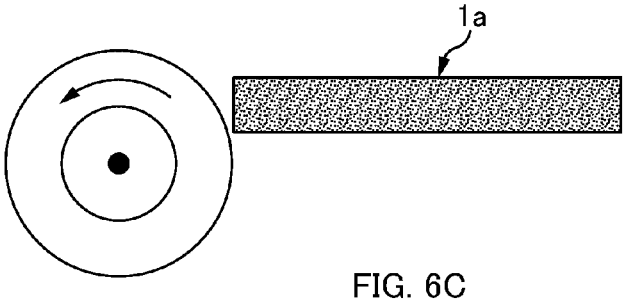
Figure 6D:
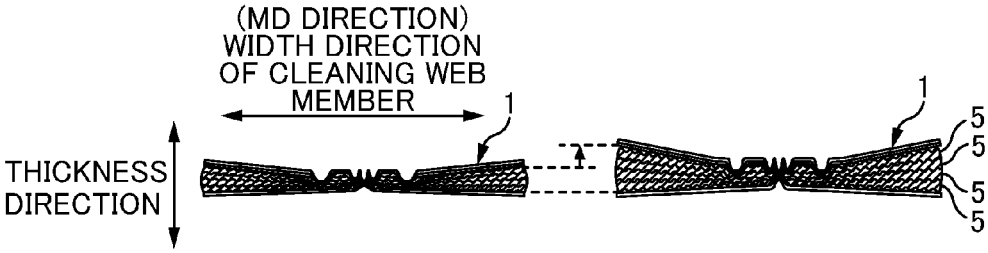
FIG. 6D shows schematic side views of the cleaning web member 1 showing a change in bulkiness caused by the rotatable blade 31.

Incidentally, if this sort of rotatable blade 31 is used, the fiber bundles 5 can have high bulkiness immediately after cutting. FIGS. 6A to 6C are explanatory diagrams showing how the rotatable blade 31 causes the fiber bundles 5 of tows to have high bulkiness at the same time as the cutting operation. The figures shows how the rotatable blade 31 moves from the one side end to the other side end in the CD direction. As shown in FIG. 6B, the semi-finished product 1*a* that is being cut by the rotatable blade 31 includes both a cut portion A1 which the cutting edge has already passed and an uncut portion A2 which the cutting edge has not passed yet. In this state, the blade faces 31*s* and 31*s* of the rotatable blade 31 are sequentially brought into contact with the cut portion A1. Due to rotation of the blade faces 31*s* and 31*s*, the tows in the cut portion A1 are spread and loosened in the thickness direction of the semi-finished product 1*a* as indicated by the short arrows in FIG. 6B. As a result, the fiber bundles 5 of tows are expanded in the thickness direction, and become very soft and bulky. Accordingly, with the cutting apparatus 10, the cleaning web member 1 is fed to the subsequent processing not in a low-bulkiness state as shown in the left portion in FIG. 6D but in a high-bulkiness state as shown in the right portion in FIG. 6D. Accordingly, it is not necessary to perform any special additional treatment for bulkiness in the subsequent processing and the like. Thus, a bulky cleaning web member 1 having high performance for trapping dust can be promptly shipped out.

In this example, the semi-finished product 1*a* is transported in a state in which the opposite face of the wiping face of the cleaning web member 1 is in contact with the transport surface of the intermittent transport mechanism 20; the wiping face is on the side where the strip sheet 7 and the fiber bundle member 5G are positioned, and the opposite face thereof is on the side where the auxiliary sheet 3 and the base sheet 2 are positioned. That is to say, in FIG. 4A, the strip sheet 7 and the fiber bundle member 5G are positioned above, and the base sheet 2 and the auxiliary sheet 3 are positioned below. This makes it easier to maintain high softness and bulkiness of the fiber bundle member 5G located closer to the wiping face, which also contributes to increasing the bulkiness of the cleaning web member 1.

Figure 7A:
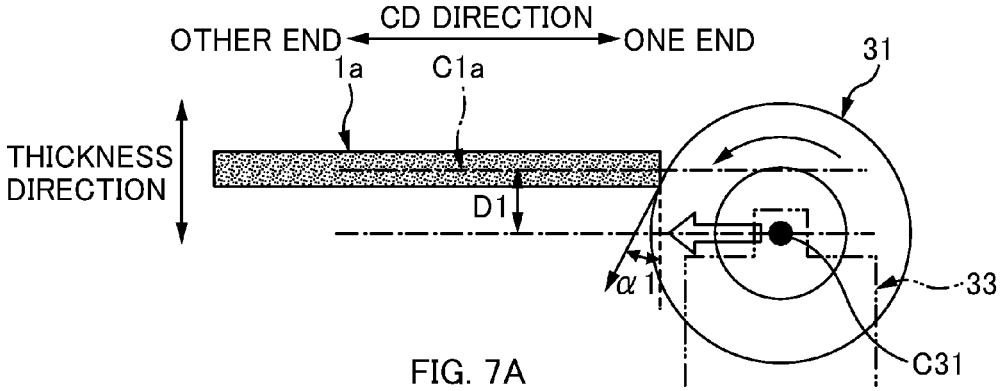
FIG. 7A is a diagram showing a positional relationship between a rotation shaft C31 of the rotatable blade 31 and a center position C1*a* in the thickness direction of the semi-finished product 1*a* according to the first embodiment.
Figure 7B:
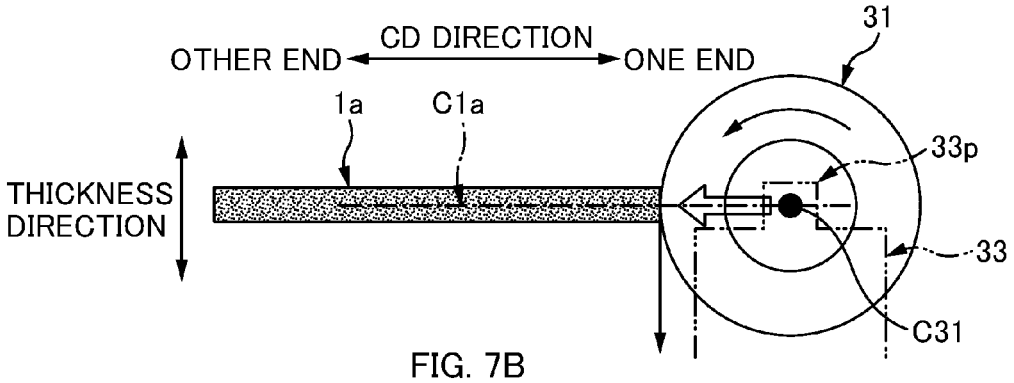
FIGS. 7B and 7C are diagrams showing a positional relationship between the rotation shaft C31 of the rotatable blade 31 and the center position C1*a* in the thickness direction of the semi-finished product 1*a* according to a comparative example.

Furthermore, as shown in FIG. 7A, in the first embodiment, the position of the rotation shaft C31 of the rotatable blade 31 is offset from a center position C1*a* in the thickness direction of the semi-finished product 1*a* by a predetermined distance D1. The reason for this is as follows. That is, if the position of the rotation shaft C31 and the center position C1*a* of the semi-finished product 1*a* match each other in the thickness direction as in the comparative example in FIG. 7B, the movement direction of the cutting edge of the rotatable blade 31 at a position where it is in contact with the semi-finished product 1*a* is parallel to the thickness direction of the semi-finished product 1*a* as shown in FIG. 7B. In this case, a large cut resistance acts on the rotatable blade 31 at the onset of cutting, and, thus, the cutting performance becomes poor. On the other hand, as shown in FIG. 7A, if the position of the rotation shaft C31 is offset from the center position C1*a* in the thickness direction of the semi-finished product 1*a* by the predetermined distance D1, the movement direction of the cutting edge at a contact position with the semi-finished product 1*a* at the onset of cutting is inclined at a predetermined angle $\alpha$1 with respect to the thickness direction of the semi-finished product 1*a*. This can reduce the cut resistance at the onset of cutting, and can achieve a good cutting performance throughout the process from the start to the end of cutting.

Figure 7C:
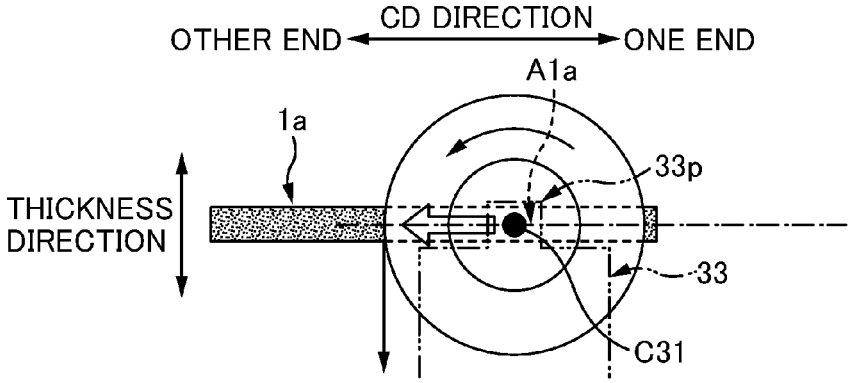

With such an offset positioning by the predetermined distance D1 as described above, the following problems are solved as well. That is to say, if the rotation shaft C31 and the center position C1*a* of the semi-finished product 1*a* match each other as in the comparative example in FIG. 7B, the rotation shaft C31 during cutting moves in the CD direction along a cut face Ala of the semi-finished product 1*a* as shown in FIG. 7C. However, the total thickness of the rotation shaft C31 and a shaft-related part 33*p* of the support platform 33 around the shaft in the MD direction is considerably larger than the thickness of the rotatable blade 31 alone because the part 33*p* exists at the position of the rotation shaft C31 in order to support the rotation shaft C31 as shown in FIG. 4C. Accordingly, when the rotation shaft C31 moves in the CD direction along the cut face Ala (FIG. 7C), there is a possibility that the resistance to the movement in the CD direction during cutting may increase because the part 33*p*, etc. are caught on the cut face A1*a*. This makes it difficult for the rotational blade to move at high speed in the CD direction, and lowers productivity. Also, there is a possibility that the part 33*p*, etc. hits hard against tows at the cut face A1*a* during the movement in the CD direction and the tows are damaged. However, if the position of the rotation shaft C31 is offset from the center position C1*a* of the semi-finished product 1*a* in the thickness direction by the predetermined distance D1 as shown in FIG. 7A, the part 33*p* of the support platform 33 around the rotation shaft C31 can be positioned away from the cut face A1*a*. Therefore, it is possible to avoid the interference between the part 33*p* and the cut face A1*a*. That is, these problems can be effectively prevented. Note that the size of the predetermined distance D1 is determined in consideration of the size of the part 33*p* such that the part 33*p* does not hit against the semi-finished product 1*a*.

Figure 8:
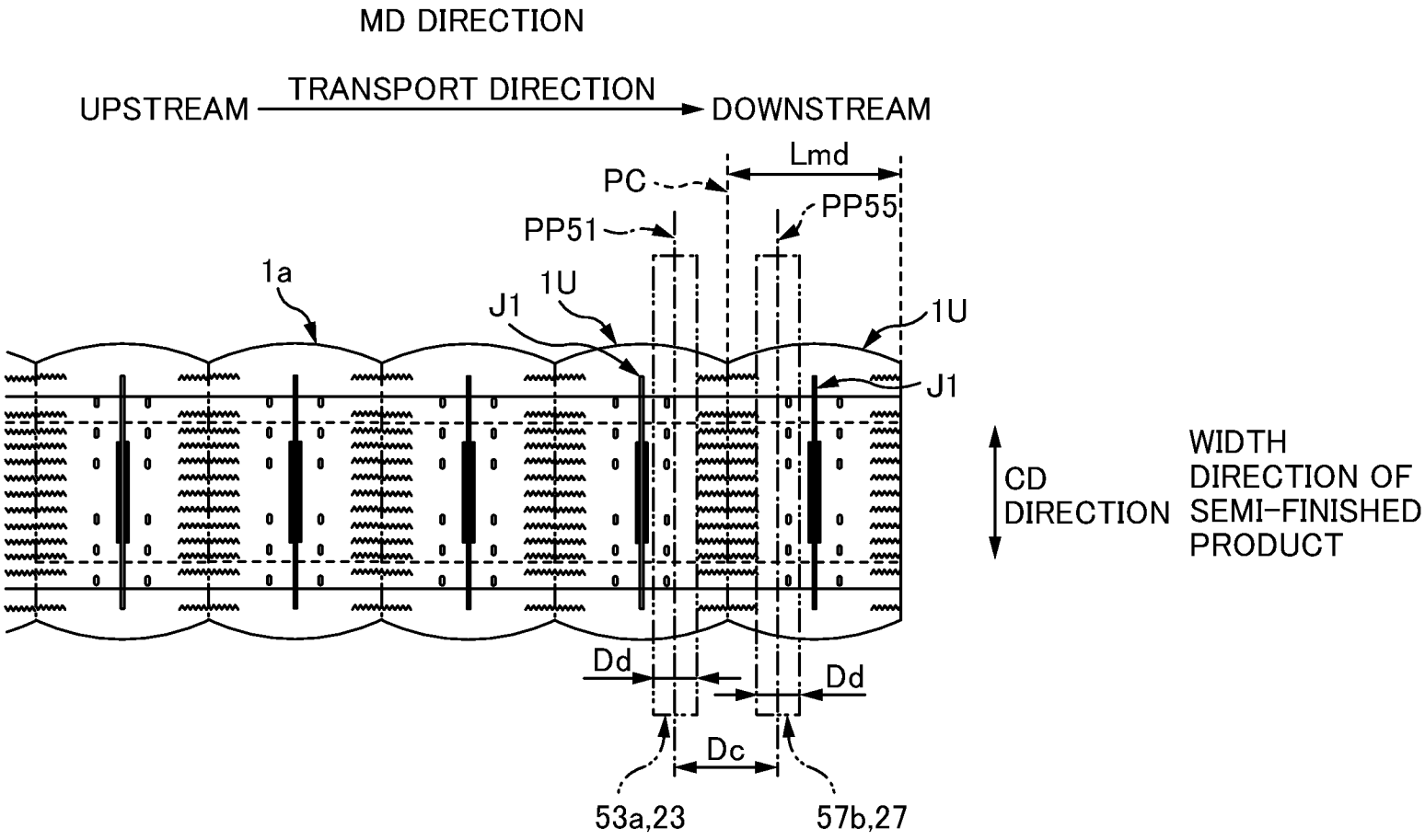
FIG. 8 is a schematic diagram showing a preferred example of press positions PP51 and PP55 of an upstream pressing member 51 and a downstream pressing member 55 on the semi-finished product 1*a*.

Furthermore, in order to reliably regulate movement of the semi-finished product 1*a* which is being cut, it is preferable that the upstream pressing member 51 and the downstream pressing member 55 are able to press positions near the target cut position PC on the semi-finished product 1*a*. For example, as shown in the schematic view of the semi-finished product 1*a* in FIG. 8, it is preferable that the press position PP55 corresponding to the downstream pressing member 55 is positioned upstream from the first welded-bonded section J1 of the semi-finished product unit 1U that is positioned at the most downstream end of the semi-finished product 1*a*. In addition, it is preferable that the press position PP51 corresponding to the upstream pressing member 51 is positioned downstream from the first welded-bonded section J1 of the semi-finished product unit 1U that is positioned immediately upstream of the above-mentioned semi-finished product unit 1U.

The press positions PP51 and PP55 are set at such positions, for example, as follows. First, the diameter Dd of the rollers 23, 27, 53*a*, and 57*b* related to pressing is preferably set to be smaller than a product size Lmd in the MD direction of the cleaning web member 1 (more preferably, smaller than half the product size Lmd (smaller than Lmd/2)). An inter-axis distance Dc between adjacent rollers of the rollers 23, 27, 53*a*, and 57*b* in the MD direction corresponding to each other (the distance Dc between the rotation axes), that is, the inter-axis distance Dc between the rollers 23 and 27 and the inter-axis distance Dc between the rollers 53*a* and 57*b* are each preferably set to be smaller than the product size Lmd (more preferably, smaller than the half the product size Lmd (smaller than Lmd/2)) within a range in which interference between the rollers does not occur.

Here, "the rollers 23, 27, 53*a*, and 57*b* related to pressing" described above refer to the following four rollers 23, 27, 53*a*, and 57*b*: of the pair of rollers 57*a* and 57*b* of the downstream pressing member 55, the upstream roller 57*b*; of the rollers 27 of the downstream belt conveyor 25, the roller 27 with which the semi-finished product 1*a* is sandwiched in cooperation with the roller 57*b* of the downstream pressing member 55; of the pair of rollers 53*a* and 53*b* of the upstream pressing member 51, the downstream roller 53*a*; and, of the rollers 23 of the upstream belt conveyor 21, the roller 23 with which the semi-finished product 1*a* is sandwiched in cooperation with the roller 53*a* of the upstream pressing member 51.

Furthermore, in the description above, the endless belt 58 of the downstream pressing member 55 in FIG. 4A is driven to circumferentially revolve in conjunction with the intermittent transport mechanism 20, but the invention is not limited thereto. For example, the endless belt 58 of the downstream pressing member 55 may be rotated by an idler roller, etc. In this case, in order to avoid obstructing the transport of the semi-finished product 1*a*, it is preferable that, in the withdrawn state in FIGS. 7B and 7C, the downstream pressing member 55 is located sufficiently away from the outer circumferential face of the endless belt 28 of the downstream belt conveyor 25 and the downstream pressing member 55 is in completely non-contact with the semi-finished product 1*a*. Also, in this case, it is desirable that an appropriate position detection sensor such as a proximity switch is provided at this withdrawn state position, and that control is performed such that, after the sensor detects that the downstream pressing member 55 has been withdrawn to that position, the transport operation of the semi-finished product 1*a* is started.

Figure 9A:
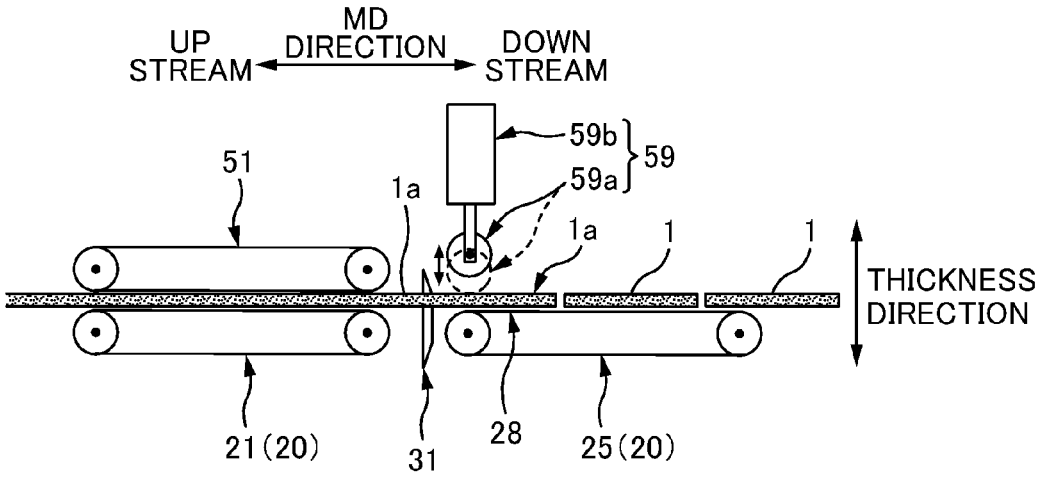
FIGS. 9A, to 9C are explanatory diagrams respectively showing modified examples of the first embodiment.
Figure 9B:
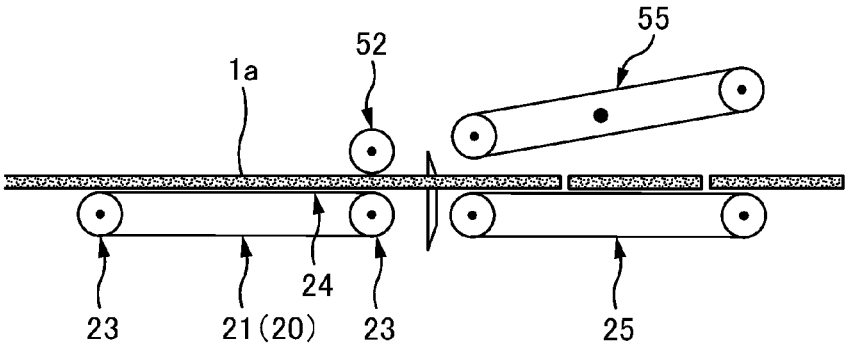
Figure 9C:
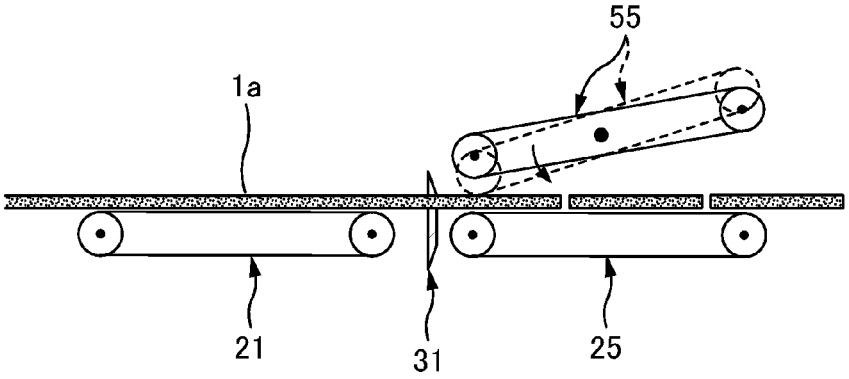

FIGS. 9A to 9C are explanatory diagrams of modified examples of the first embodiment, respectively showing schematic side views. In the description below, different aspects will be mainly described, and the same constituent components are denoted by the same reference numerals and a description thereof has been omitted.

A first modified example shown in FIG. 9A is different from the foregoing example in the configuration of the downstream pressing member 55. That is to say, a downstream pressing member 59 of this first modified example includes: one roller 59*a* that opposes the outer circumferential face of the endless belt 28 of the downstream belt conveyor 25; and an actuator 59*b* that reciprocally moves the roller 59*a* in the thickness direction of the semi-finished product 1*a*. Note that the actuator 59*b* is, for example, a hydraulic cylinder, an air cylinder, or the like.

With this configuration, a pressing state in which the semi-finished product 1*a* is pressed against the outer circumferential face of the downstream belt conveyor 25 can be obtained by moving the roller 59*a* toward the outer circumferential face of the downstream belt conveyor 25. And, a withdrawn state in which the space between the roller 59*a* and the outer circumferential face of the downstream belt conveyor 25 has increased can be obtained by moving the roller 59*a* in a direction in which it is away from the outer circumferential face of the downstream belt conveyor 25.

The roller 59*a* may be provided with a driving source such as a servomotor so as to be intermittently rotated in conjunction with the intermittent transport operation by the intermittent transport mechanism 20. Or, the roller 59*a* may be rotated by means such as an idler roller without being provided with a driving source.

A second modified example shown in FIG. 9B is different from the foregoing example in the configuration of the upstream pressing member 51. That is to say, an upstream pressing member 52 of this second modified example has one roller 52 that opposes the outer circumferential face of the endless belt 24 of the upstream belt conveyor 21. The roller 52 receives a pressing force applied from an appropriate pressing-force-applying mechanism, so that the roller 52 constantly presses the semi-finished product 1*a* against the upstream belt conveyor 21.

The roller 52 may be a drive roller that is driven to rotate, or may be an idler roller that is rotated by a rotational force obtained from the semi-finished product 1*a* that is in contact therewith. Note that, in the case of the drive roller, the roller 52 has to be intermittently rotated in conjunction with the intermittent transport operation of the intermittent transport mechanism 20. In this case, the roller 52 may obtain a rotational force from the driving source for the upstream belt conveyor 21 via an appropriate power transmission mechanism, or an additional driving source such as a servomotor may control the roller 52 in conjunction with the intermittent transport operation.

A third modified example shown in FIG. 9C is different from the foregoing example in that the upstream pressing member 51 has been omitted. The reason why the upstream pressing member 51 can be omitted is as follows. During cutting of the semi-finished product 1*a*, a downstream end portion in the semi-finished product 1*a* is pressed by the downstream pressing member 55 (see the state indicated by the broken line for the downstream pressing member 55 in FIG. 9C). At that time, a tensile force in the MD direction for transport is also generated on the semi-finished product 1*a*. Accordingly, these pressing and tensile forces regulate movement of the semi-finished product 1*a* during cutting. Therefore, it is not absolutely necessary for the upstream pressing member 51 to be provided. However, since the tensile force of the semi-finished product 1*a* decreases as the cutting in the CD direction by the rotatable blade 31 proceeds, it is desirable that the upstream pressing member 51 is provided in order to stably regulate movement of the semi-finished product 1*a*.

=Second Embodiment=

Figure 10C:
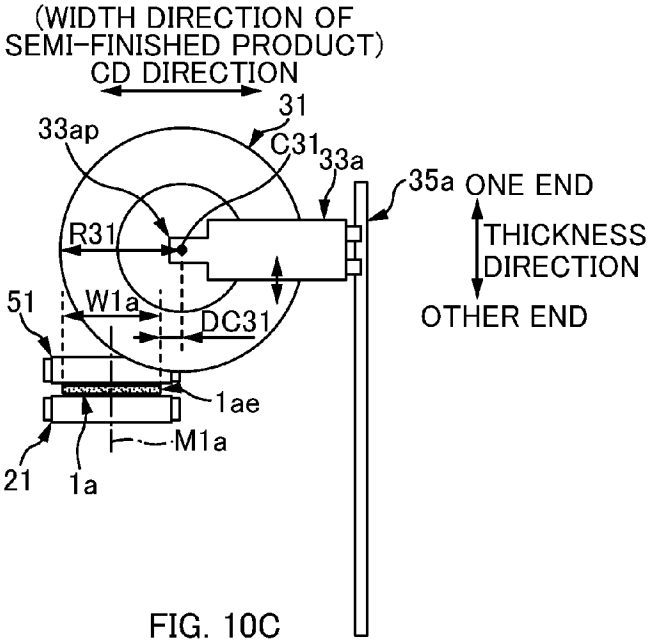
FIG. 10A is a schematic side view of a cutting apparatus 10*a* of a second embodiment.
FIG. 10B is a view along arrows B-B in FIG. 10A, and, FIG. 10C is a view along arrows C-C in FIG. 10A.
Figure 10A:
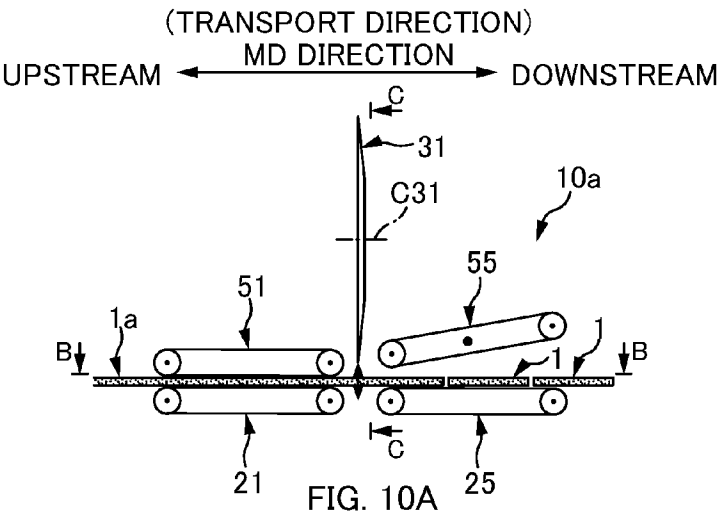
Figure 10B:
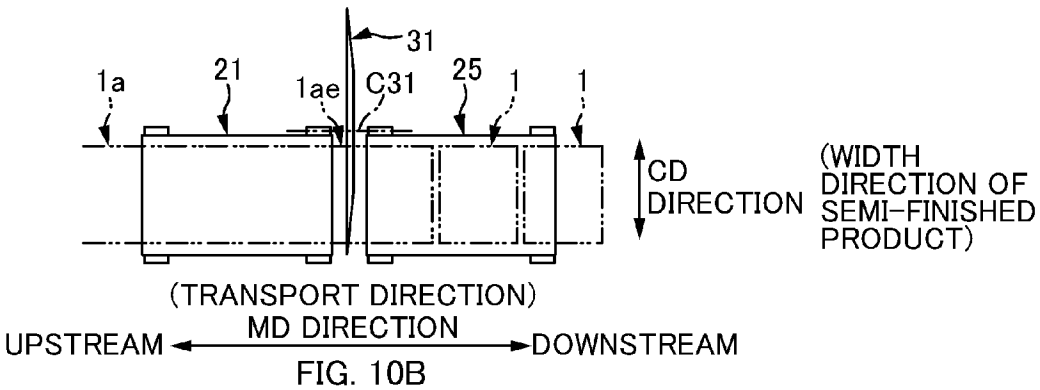

FIG. 10A is a schematic side view of a cutting apparatus 10*a* of a second embodiment, FIG. 10B is a view along arrows B-B in FIG. 10A, and FIG. 10C is a view along arrows C-C in FIG. 10A.

The second embodiment is different from the first embodiment mainly in that the movement direction of the rotatable blade 31 in the cutting apparatus 10*a* is not along the CD direction but along the thickness direction of the semi-finished product 1*a* (corresponding to an intersecting direction). Portions other than the above are substantially similar to those in the first embodiment. Accordingly, in the description below, the same sign is used for the same configurations as the first embodiment, and description thereof is omitted.

During a transport suspension of the semi-finished product 1*a*, the rotatable blade 31 in the cutting apparatus 10*a* moves from the one side to the other side in the thickness direction of the semi-finished product 1*a* or moves from the other side to the one side in the thickness direction while being driven and rotated about the rotation shaft C31 along the MD direction. The cutting edge of the rotatable blade 31 that is being driven and rotated cuts the semi-finished product 1*a* during the movement. Hereinafter, the thickness direction of the semi-finished product is also simply referred to as a "thickness direction".

The rotatable blade 31 is reciprocally moved as follows. First, a support platform 33*a* that supports the rotatable blade 31 in a rotatable manner is guided so as to be reciprocally movable in the thickness direction along an appropriate guide member 35*a* such as a linear guide. The support platform 33*a* is reciprocally moved in the thickness direction of the semi-finished product 1*a* by an appropriate drive mechanism (not shown). Each stroke distance in the forward path and the return path according to the reciprocal movement is set to a distance that allows the entire rotatable blade 31 to cross the semi-finished product la throughout in the thickness direction. Furthermore, the drive mechanism (not shown) that moves the rotatable blade 31 in the thickness direction includes: for example, a pair of pulleys that are arranged in the thickness direction; an endless timing belt that is wrapped around the pair of pulleys; and a servomotor as a driving source that rotates the pulleys. Part of the endless timing belt is secured to the support platform 33*a*. Accordingly, when the servomotor repeatedly rotates clockwise and anti-clockwise, the rotatable blade 31 is reciprocally moved in the thickness direction.

Incidentally, in this example, as shown in FIGS. 10B and 10C, the rotation shaft C31 of the rotatable blade 31 is located outside an edge lae of the semi-finished product 1*a* in the CD direction. The reason for this is similar to that described in the foregoing first embodiment. That is to say, this arrangement is for preventing a part 33*ap* of the support platform 33*a* from interfering with the semi-finished product 1*a* during cutting, which results in obstructing smooth cutting. The radius R31 of the rotatable blade 31 is set at a larger value than Rs that is calculated using the following Formula 1 so that the semi-finished product 1*a* can be cut throughout the entire width even when the rotation shaft C31 is significantly separated in the CD direction from a center position M1*a* of the semi-finished product 1*a* as mentioned above.

$Rs$=(Width $W1a$ of Semi-finished product 1$a$)+(Distance $DC31$ in CD direction between Edge 1*ae* of Semi-finished product 1*a* and Rotation shaft $C31$) (1)

Figure 11B:
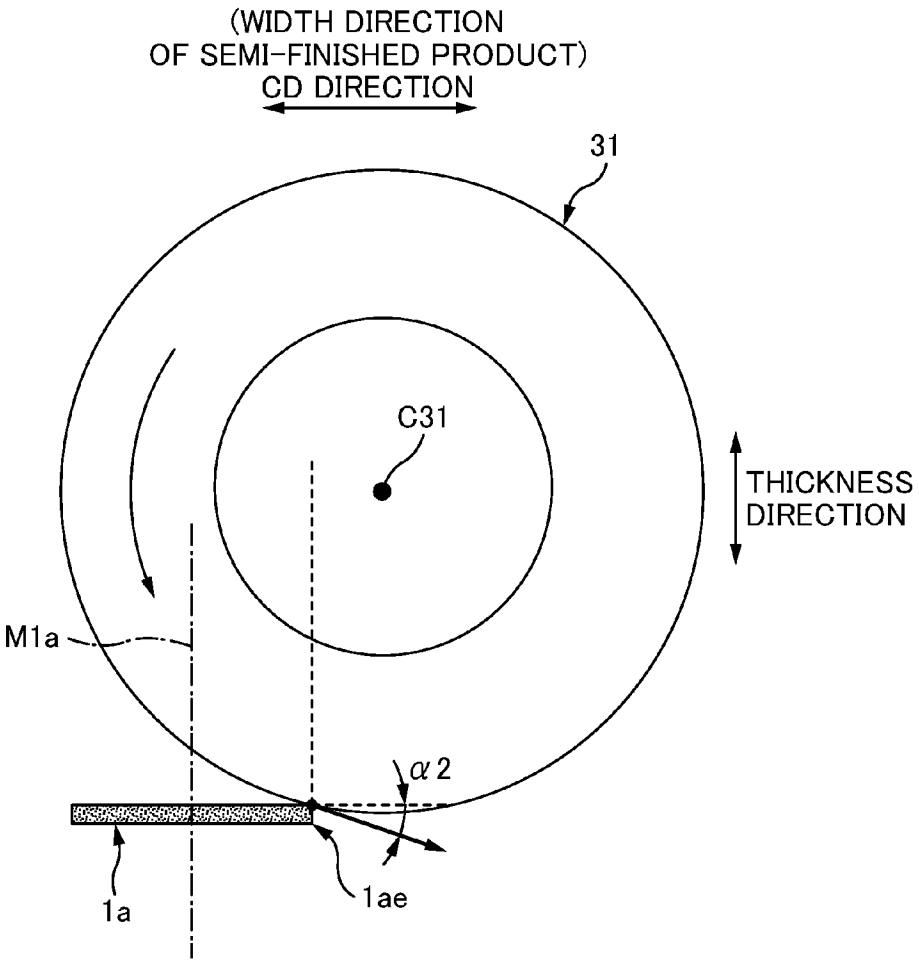
FIG. 11B is a diagram showing a positional relationship between the rotation shaft C31 of the rotatable blade 31 and the center position M1*a* in the width direction of the semi-finished product 1*a* according to the second embodiment.
Figure 11A:
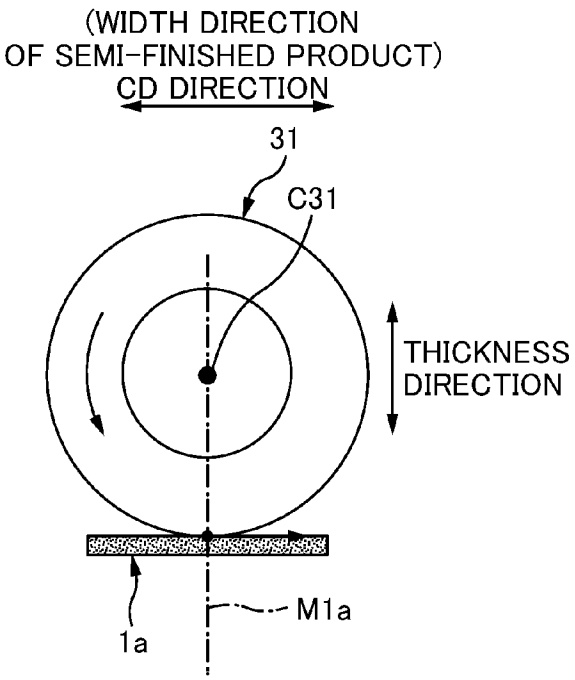
FIG. 11A is a diagram showing a positional relationship between the rotation shaft C31 of the rotatable blade 31 and a center position M1*a* in the width direction of the semi-finished product 1*a* according to a comparative example.

Such a separate arrangement also achieves an effect of an improved cutting performance at the onset of cutting. FIGS. 11A and 11B are explanatory diagrams thereof. In a comparative example in FIG. 11A, the position of the rotation shaft C31 of the rotatable blade 31 matches the center position M1*a* in the CD direction of the semi-finished product 1*a*, that is, these positions are the same in the CD direction. In this case, at the onset of cutting as shown in FIG. 11A, the movement direction along which the cutting edge of the rotatable blade 31 moves at a position where it is in contact with the semi-finished product 1*a* is parallel to the width direction (the CD direction) of the semi-finished product 1*a*. Accordingly, a large cut resistance acts on the rotatable blade 31 at the onset of cutting, and, thus, the cutting performance becomes poor. On the other hand, if the rotation shaft C31 of the rotatable blade 31 is located outside the edge lae of the semi-finished product 1*a* in the CD direction as shown in FIG. 11B, the movement direction of the cutting edge at a position where it is in contact with the semi-finished product 1*a* forms a certain inclination angle $\alpha$2 with respect to the width direction (the CD direction) of the semi-finished product 1*a* from the onset of cutting. This can reduce the cut resistance at the onset of cutting, and can achieve a good cutting performance throughout the process from the start to the end of cutting.

Note that, as is clear from a comparison between FIGS. 4B and 10B, according to the second embodiment, the size of the rotatable blade 31 is larger than that in the first embodiment. Therefore, the first embodiment is more desirable in order to reduce the size of the rotatable blade 31.

=Other Embodiments=

While the automatic urine disposal apparatus is described as the defecation/urination determination apparatus of the present invention with reference to the preferred embodiment, the embodiment is for the purpose of elucidating the understanding of the invention and is not to be interpreted as limiting the invention. The invention can of course be altered and improved without departing from the gist thereof, and equivalents are intended to be embraced therein.

In the foregoing embodiments, the semi-finished product 1*a* according to the cleaning web member 1 is shown as an exemplary web member, but the invention is not limited thereto. That is to say, any web member may be applied as long as it has a plurality of fibers including tows and it is continuous in the transport direction.

In the foregoing embodiments, the cutting edge of the rotatable blade 31 is not described in detail. However, this cutting edge may be smooth one that has no recess portion throughout the entire outer circumferential edge of the rotatable blade 31, or may be one that has a plurality of recess portions along the outer circumferential edge of the rotatable blade 31. Note that, if the latter one is applied, tows of the semi-finished product 1*a* can be cut while being caught on the recess portions. This further improves the cutting performance. Examples of such a cutting edge having recess portions include a saw blade and the like, but the invention is not limited thereto. For example, the concept of the foregoing recess portions includes notches formed by cutting off part of the cutting edge at a depth exceeding 2 μm (the size in the radial direction of the rotatable blade 31) during polishing. Note that the depth is preferably 5 μm or less, because adhesion of molten residue of the tows to the cutting edge can be suppressed, and a high cutting performance can be maintained for a long time.

Furthermore, it is preferably set to the range of 15° to 20° an angle $\alpha$31 of the cutting edge (FIG. 4B), that is, the angle $\alpha$31 between the outer circumferential edge portions of both blade faces 31*s* in the thickness direction of the rotatable blade 31. This is because angles in this range can achieve a high cutting performance, and also can effectively suppress fractures in the cutting edge during polishing, which is likely to occur if the rotatable blade 31 is made of cemented carbide in order to improve the life. The rotation shaft C31 of the rotatable blade 31 is set parallel to the normal direction of the blade faces 31*s*.

What is claimed is:

1. A web-member cutting apparatus for cutting a web member at intervals in a transport direction, the web member having a plurality of fibers including tows along the transport direction and being continuous in the transport direction, the web-member cutting apparatus comprising:

an intermittent transport mechanism for intermittently transporting the web member in the transport direction;

a disc-like rotatable blade member positioned for cutting the web member by moving along an intersecting direction while rotating about a rotation shaft during a suspension period of transport of the web member without the rotatable blade member engaging an opposing member, the intersecting direction intersecting the transport direction, the rotation shaft extending along the transport direction; and a downstream pressing member that regulates movement of the web member by pressing the web member against the intermittent transport mechanism at a position downstream from a target cut position in the transport direction throughout a period during which the rotatable blade member is cutting the web member.

2. A web-member cutting apparatus according to claim 1, wherein the intersecting direction along which the rotatable blade member moves is a width direction of the web member.

3. A web-member cutting apparatus according to claim 2, wherein the rotatable blade member is guided so as to be reciprocally movable in the width direction, and a moving operation of the rotatable blade member along the width direction during a suspension period of transport of the web member is performed in a direction opposite a direction of a moving operation of the rotatable blade member during a suspension period immediately before the period.

4. A web-member cutting apparatus according to claim 1, wherein the web-member cutting apparatus further comprises an upstream pressing member that regulates movement of the web member by pressing the web member against the intermittent transport mechanism at a position upstream from the target cut position in the transport direction throughout a period during which the rotatable blade member is cutting the web member.

5. A web-member cutting apparatus according to claim 1, wherein the intermittent transport mechanism includes an upstream belt conveyor that is disposed upstream in the transport direction from the rotatable blade member and a downstream belt conveyor that is disposed downstream in the transport direction from the rotatable blade member, and during a suspension period of transport of the web member, a predetermined portion of the downstream pressing member is in a pressing state in which the predetermined portion is in contact with the web member and in which the predetermined portion presses the web member against a transport surface of the downstream belt conveyor, and, during a period of transport of the web member, the predetermined portion is in a withdrawn state in which the predetermined portion is located at a greater distance from the transport surface of the downstream belt conveyor than the position of the predetermined portion in the pressing state is.

6. A web-member cutting apparatus according to claim 5, wherein the downstream pressing member includes an endless belt member that is disposed at a position where the web member is sandwiched between the endless belt member and the downstream belt conveyor, the endless belt member is intermittently driven and revolves in conjunction with an intermittent transport operation by the downstream belt conveyor, the endless belt member is pivotally supported so as to oscillate about a rotation shaft along a width direction of the web member, an upstream end portion of the endless belt member in the transport direction is the predetermined portion, and the pressing state and the withdrawn state of the upstream end portion are alternately switched through an oscillation operation of the endless belt member.

7. A web-member cutting apparatus according to claim 6, wherein, during a period of transport of the web member, a downstream end portion of the endless belt member is located at a greater distance from the transport surface of the downstream belt conveyor than the upstream end portion is.

8. A web-member cutting apparatus according to claim 7, wherein a cut sheet-like product formed by cutting the web member is used for cleaning, and the web member is transported in a state in which an opposite face of a face which is to be a wiping face during cleaning is in contact with a transport surface of the intermittent transport mechanism.

9. A web-member cutting apparatus according to claim 2, wherein a position of the rotation shaft of the rotatable blade member is offset from a center position of the web member in a thickness direction of the web member.

10. A web-member cutting apparatus according to claim 1, wherein, while the web member is being cut at the target cut position, tows that is located at the target cut position and has already cut are spread and loosened in a thickness direction of the web member by a blade face of the rotatable blade member being contact of with the tows.

11. A method for cutting a web member at intervals in a transport direction, the web member having a plurality of fibers including tows along the transport direction and being continuous in the transport direction, the method comprising:

intermittently transporting the web member in the transport direction;

cutting the web member by moving a disc-like rotatable blade member along an intersecting direction with the rotatable blade member rotating about a rotation shaft during a suspension period of transport of the web member without the rotatable blade member engaging an opposing member, the intersecting direction intersecting the transport direction, the rotation shaft extending along the transport direction; and regulating movement of the web member by pressing the web member against the intermittent transport mechanism at a position downstream from a target cut position in the transport direction throughout a period during which the rotatable blade member is cutting the web member.

* * * * *